US008855519B2

(12) United States Patent
Katahira et al.

(10) Patent No.: US 8,855,519 B2
(45) Date of Patent: Oct. 7, 2014

(54) BLOWING DEVICE AND IMAGE FORMING APPARATUS

(75) Inventors: Masahiro Katahira, Kanagawa (JP); Yuki Nagamori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 212 days.

(21) Appl. No.: 13/470,858

(22) Filed: May 14, 2012

(65) Prior Publication Data

US 2013/0108307 A1 May 2, 2013

(30) Foreign Application Priority Data

Oct. 31, 2011 (JP) ..... 2011-238806

(51) Int. Cl.
*G03G 21/20* (2006.01)
*G03G 15/02* (2006.01)

(52) U.S. Cl.
CPC ..... *G03G 15/0258* (2013.01); *G03G 21/206* (2013.01)
USPC ..... 399/92

(58) Field of Classification Search
CPC ..... G03G 15/2017; G03G 15/0258; G03G 15/0291
USPC ..... 399/92
See application file for complete search history.

(56) References Cited

U.S. PATENT DOCUMENTS

| | | | | |
|---|---|---|---|---|
| 4,745,282 | A * | 5/1988 | Tagawa et al. | 250/326 |
| 2007/0036577 | A1* | 2/2007 | Okabe et al. | 399/92 |
| 2009/0074463 | A1* | 3/2009 | Nishio et al. | 399/170 |
| 2011/0121510 | A1* | 5/2011 | Tsuda et al. | 271/226 |

FOREIGN PATENT DOCUMENTS

| | | | |
|---|---|---|---|
| JP | 10-198128 | A | 7/1998 |
| JP | 2001-235930 | A | 8/2001 |
| JP | 2001-331016 | A | 11/2001 |

OTHER PUBLICATIONS

Machine translation of JP 10198128 A, publication date: Jul. 31, 1998.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

A blowing device includes a blower that blows air and an air duct including an inlet and an outlet. The air duct takes in the air through the inlet and guiding the air so that the air flows out through the outlet toward a corona discharge unit including a target component toward which the air is to be blown. The outlet of the air duct includes a through-portion in a non-overlapping region thereof, the non-overlapping region being a region of the outlet excluding an overlapping region of the outlet. The overlapping region corresponds to an interposed component of the corona discharge unit, the interposed component being located between the outlet and the target component at a position at which the interposed component overlaps the overlapping region.

10 Claims, 23 Drawing Sheets

BLOWING DEVICE AND IMAGE FORMING APPARATUS

CROSS-REFERENCE TO RELATED APPLICATIONS

This application is based on and claims priority under 35 USC 119 from Japanese Patent Application No. 2011-238806 filed Oct. 31, 2011.

BACKGROUND (i) Technical Field

The present invention relates to a blowing device and an image forming apparatus.

(ii) Related Art

There are image forming apparatuses, which form an image composed of a developer on a recording sheet, including a corona discharge unit that performs corona discharge. The corona discharge unit is used, for example, when charging a latent image carrier such as a photoconductor, when removing charges from the latent image carrier, and when transferring an unfixed image to a recording sheet.

Some corona discharge units are equipped with a blowing device that blows air to components such as a discharge wire and a grid electrode to prevent wastes such as paper dust and corona by-products from adhering to the components. In general, such a blowing device includes a blower that blows air and a duct (air duct) that guides the air to an object structure such as the corona discharge unit.

SUMMARY

According to an aspect of the present invention, a blowing device includes a blower that blows air and an air duct including an inlet and an outlet. The air duct takes in the air through the inlet and guiding the air so that the air flows out through the outlet toward a corona discharge unit including a target component toward which the air is to be blown. The outlet of the air duct includes a through-portion in a non-overlapping region thereof, the non-overlapping region being a region of the outlet excluding an overlapping region of the outlet. The overlapping region corresponds to an interposed component of the corona discharge unit, the interposed component being located between the outlet and the target component at a position at which the interposed component overlaps the overlapping region.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Exemplary Embodiment

Figure 1:
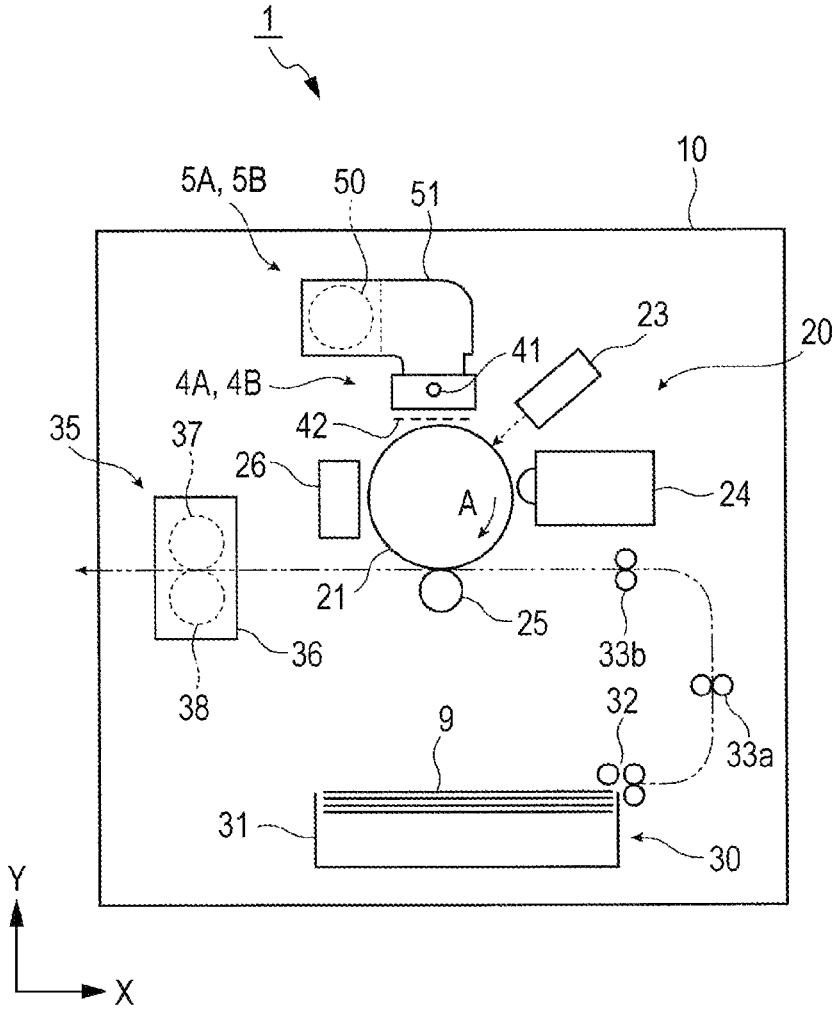
FIG. 1 is a schematic view of an image forming apparatus including a blowing device according to an exemplary embodiment.
Figure 2A:
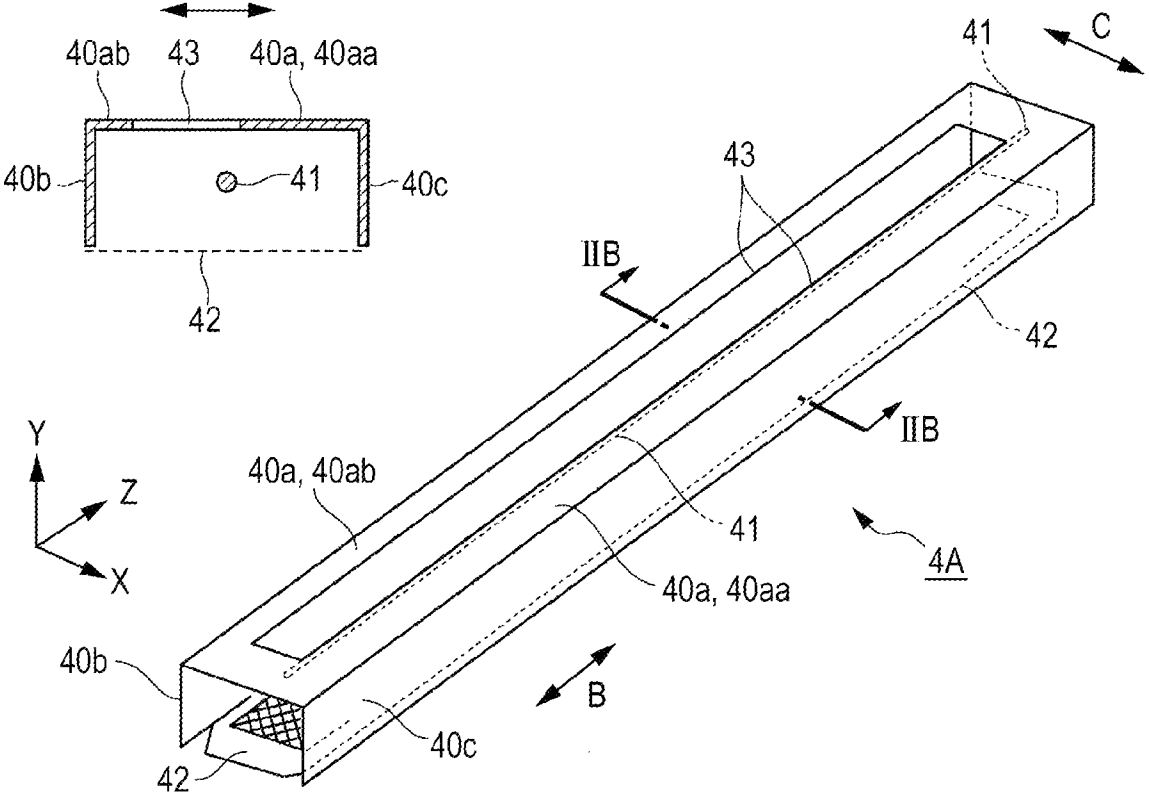
FIG. 2A is a schematic perspective view of a charger, including a corona discharge unit, of the image forming apparatus of FIG. 1.
Figure 2B:
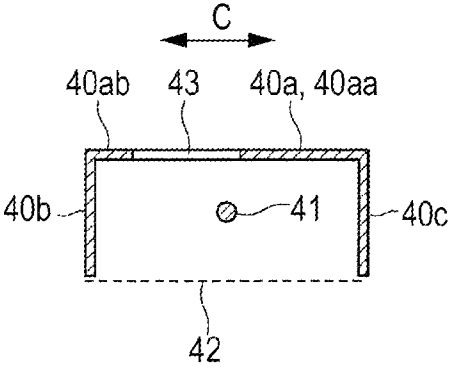
FIG. 2B is a schematic sectional view of the charger taken along line IIB-IIB of FIG. 2A.
Figure 3:
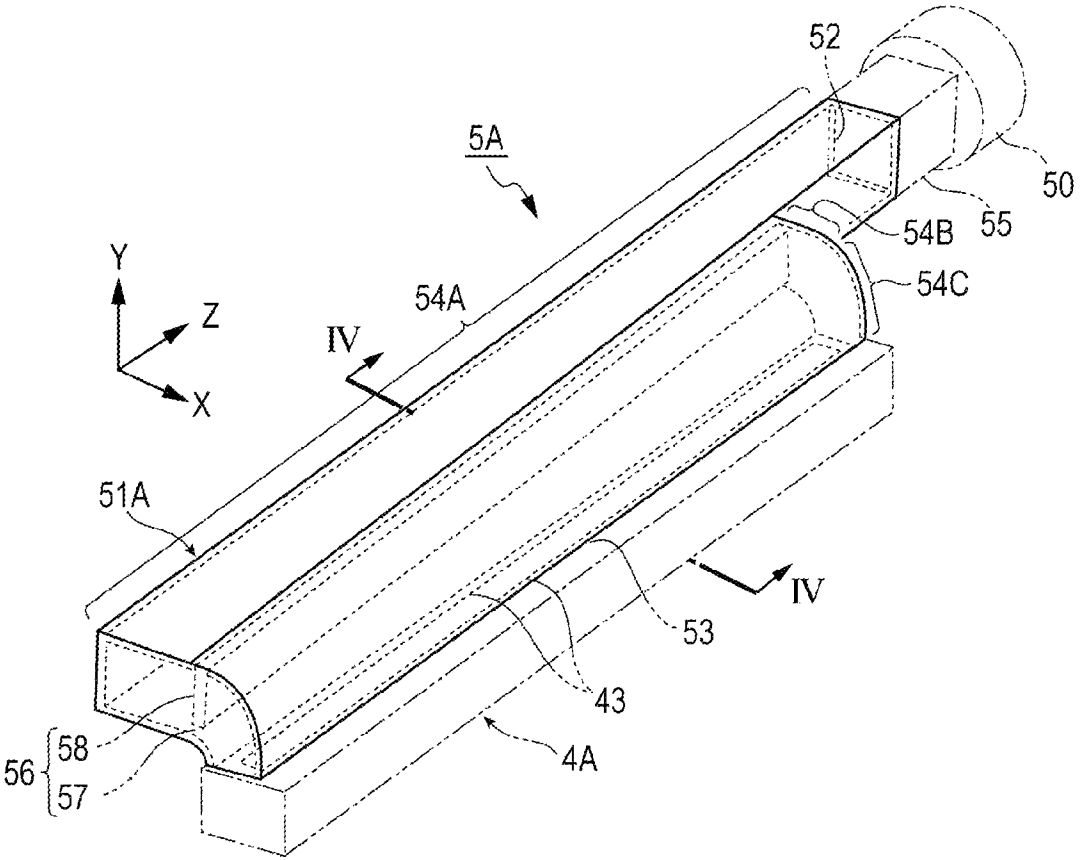
FIG. 3 is a schematic perspective view of a blowing device provided to the charger of FIG. 2.

FIGS. 1 to 3 illustrate an image forming apparatus including a blowing device according to a first exemplary embodiment. FIG. 1 is a schematic view of the image forming apparatus. FIG. 2 illustrates a charger of the image forming apparatus, which includes a target component toward which the blowing device is to blow air. FIG. 3 is a schematic view of the blowing device.

As illustrated in FIG. 1, an image forming apparatus 1 includes a housing 10, an image forming unit 20, a sheet feeder 30, and a fixing unit 35, which are disposed in the space inside the housing 10. The housing includes a support frame, an outer cover, and the like. The image forming unit 20 forms a toner image from a toner, which is an example of a developer, and transfers the toner image to a sheet 9, which is an example of a recording member. The sheet feeder 30 contains the sheet 9 and transports the sheet 9 that is supplied to the image forming unit 20. The fixing unit 35 fixed a toner image, which has been formed by the image forming unit 20, to the sheet 9. In the first exemplary embodiment, there is only one image forming unit 20. However, there may be plural image forming units.

The image forming unit 20 employs, for example, a known electrophotographic system. The image forming unit 20 includes a photoconductor drum 21, a charger 4A, an exposure device 23, a developing device 24, a transfer device 25, and a cleaner 26. The photoconductor drum 21 rotates in the direction indicated by arrow A (clockwise in FIG. 1). The charger 4A charges the outer peripheral surface of the photoconductor drum 21, which serves as an image forming region, to an appropriate potential. The exposure device 23 irradiates the charged surface of the photoconductor drum 21 with light (shown in FIG. 1 by a broken line with an arrowhead) in accordance with image information (signal) that is input from the outside and thereby forms an electrostatic latent image having a potential difference. The developing device 24 develops the electrostatic latent image to form a toner image by using toner. The transfer device 25 transfers the toner image to the sheet 9. The cleaner 26 removes toner that remains on the photoconductor drum 21 after the toner image has been transferred.

A corona discharge unit is used as the charger 4A. As illustrated in FIG. 2 and other figures, the charger 4A is a so-called scorotron corona discharge unit that includes a shield case 40 (covering member), two end supporters (not shown), a corona discharge wire 41, and a grid electrode 42 (electric field adjustment plate). The shield case 40 includes a rectangular top panel 40*a* (upper surface portion) and side panels 40*b* and 40*c*. The side panels 40*b* and 40*c* extend downward from long sides of the top panel 40*a*, which extend along the longitudinal direction B of the top panel 40*a*. The two end supporters are respectively attached to two end portions (short sides) of the shield case 40 in the longitudinal direction B. The corona discharge wire 41 extends substantially linearly in the space inside the shield case 40 between the two end supporters. The grid electrode 42 is attached to the shield case 40 so as to cover the lower opening of the shield case 40 at a position between the corona discharge wire 41 and the outer peripheral surface of the photoconductor drum 21.

The charger 4A is disposed such that the corona discharge wire 41 faces the outer peripheral surface of the photoconductor drum 21 with an appropriate distance (for example, a discharge gap) therebetween and the discharge wire 41 is present in at least an image forming region of the photoconductor drum 21 along the axial direction of the photoconductor drum 21. The charger 4A is configured such that, when the image forming apparatus 1 forms an image, an electric power supply (not shown) applies a charging potential to (a space between the photoconductor drum 21 and) the discharge wire 41.

While the charger 4A is used, the corona discharge wire 41 and the grid electrode 42 become contaminated as substances (wastes) such as paper dust of the sheet 9, corona by-product generated by the corona discharge, and toner additives adhere to them. As a result, corona discharge may not be sufficiently and uniformly performed, and defective charging such as nonuniform charging may occur. For this reason, the charger 4A is provided with a blowing device 5A that blows air toward the discharge wire 41 and the grid electrode 42 to prevent wastes from adhering to the discharge wire 41 and the grid electrode 42. The discharge wire 41 and the grid electrode 42 are examples of a target component toward which air is to be blown in the charger 4A.

In order to couple the charger 4A with the blowing device 5A, an opening 43, through which air is taken in from the blowing device 5A, is formed in a part of the top panel 40*a* of the shield case 40 of the charger 4A. As illustrated in FIGS. 2A and 2B and other figures, the opening 43 has a rectangular shape and is positioned so as to be displaced into substantially one of the half regions of the top panel 40*a* with respect to a transversal direction C that is substantially perpendicular to the longitudinal direction B. The details of the blowing device 5A will be described below.

The sheet feeder 30 includes a sheet container 31 and a feeding device 32. The sheet container 31 is, for example, a tray or a cassette for holding a stack of plural sheets 9 that have, for example, appropriate sizes and characteristics and that are used to form images thereon. The feeding device 32 feeds the sheets 9, which are contained in the sheet container 31, one by one to a transport path when it becomes necessary to feed the sheet 9. There may be plural sheet containers 31 in accordance with the modes of use. In FIG. 1, two-dot chain line with an arrowhead shows a sheet transport path along which the sheet 9 is transported. The sheet transport path includes pairs of sheet transport rollers 33*a* and 33*b*, a transport guide member (not shown), and the like.

The fixing unit 35 includes a housing 36 having a sheet inlet and a sheet outlet, and a rotary heating member 37 and a rotary pressing member 38 that are disposed in the housing 36. The rotary heating member 37 is roller-shaped or belt-shaped, and the surface of the rotary heating member 37 is heated to an appropriate temperature and maintained at the temperature. The rotary pressing member 38 is roller-shaped or belt-shaped, extends substantially in the axial direction of the rotary heating member 37. The rotary pressing member 38 is rotated while being in contact with the rotary heating member 37 with an appropriate pressure. The fixing unit 35 fixes a toner image to the sheet 9 while the sheet 9, to which the toner image has been transferred, passes a fixing region between the rotary heating member 37 and the rotary pressing member 38.

The image forming apparatus 1 forms an image as follows. Here, a basic image forming operation of forming an image on one side of the sheet 9 will be described as an example.

When a control device or the like of the image forming apparatus 1 receives an instruction to start forming an image, in the image forming unit 20, the outer peripheral surface of the photoconductor drum 21, which has started rotating, is charged by the charger 4A to an appropriate potential with a predetermined polarity. At this time, in the charger 4A, a charging potential is applied to the corona discharge wire 41 to cause corona discharge while an electric field is formed between the discharge wire 41 and the outer peripheral surface of the photoconductor drum 21, and thereby the outer peripheral surface of the photoconductor drum 21 is charged to an appropriate potential. The charging potential of the photoconductor drum 21 is adjusted through the grid electrode 42.

The exposure device 23 exposes the charged outer peripheral surface of the photoconductor drum 21 with light in accordance with image information, and thereby an electrostatic latent image having an appropriate potential difference is formed. Subsequently, when the electrostatic latent image formed on the photoconductor drum 111 passes the developing device 24, the electrostatic latent image is developed to form a visible toner image from toner, which is supplied from a development roller 24*a* and which has been charged with an appropriate polarity.

As the photoconductor drum 21 rotates, the toner image formed on the photoconductor drum 21 is transported to a transfer position at which the photoconductor drum 21 faces the transfer device 25. The sheet 9 is transported from the sheet feeder 30 to reach the transfer position at this timing, and the transfer device 25 transfers the toner image to the sheet 9. After the toner image has been transferred, the cleaner 26 cleans the outer peripheral surface of the photoconductor drum 21.

The sheet 9, to which the toner image has been transferred by the image forming unit 20, is removed from the photoconductor drum 21 and transported into the fixing unit 35. The sheet 9 is heated and pressed while the sheet 9 passes through the fixing region between the rotary heating member 37 and the rotary pressing member 38 in the fixing unit 35, and thereby the toner image is fused and fixed to the sheet 9. After the toner image has been fixed to the sheet 9, the sheet 9 is discharged from the fixing unit 35, transported to a sheet output tray (not shown) that is disposed, for example, outside of the housing 10, and held on the sheet output tray.

Thus, a color image is formed from a single color toner on one side of the sheet 9, and the basic image forming operation is finished. When an instruction to form plural images is received, the process described above is repeated for the number of the images.

Next, the blowing device 5A will be described.

As illustrated in FIGS. 1 and 3 and other figures, the blowing device 5A includes a blower 50 and an air duct 51A. The blower 50 includes a fan that blows air. The air duct 51A guides the air blown by the blower 50 and discharges the air toward the charger 4A.

The blower 50 is, for example, an axial-flow fan that is controlled so as to blow an appropriate amount of air. As illustrated in FIGS. 3 to 6, the air duct 51A includes an inlet 52, an outlet 53, and a body 54. The inlet 52 takes in air blown by the blower 50. The outlet 53 is disposed so as to substantially face a longitudinal portion of the charger 4A extending in the longitudinal direction B. The charger 4A includes target components (41 and 42) toward which the air taken in from the inlet 52 is to be blown, and the longitudinal portion is a part of the top panel 40*a* of the shield case 40 in which the opening 43 is formed. The outlet 53 discharges the air in a direction perpendicular to the longitudinal direction B. The body 54 has a passage space 54*a* through which air flows from the inlet 52 to the outlet 53.

The body 54 of the air duct 51A includes an intake passage 54A, a first bent passage 54B, and a second bent passage 54C. The intake passage 54A is angular pipe-shaped and has an end portion that is open as the inlet 52 and the other end portion that is closed, and the entirety of the intake passage 54A extends in the longitudinal direction B of the charger 4A. The first bent passage 54B is angular pipe-shaped and extends from a part of the intake passage 54A near the other end portion of the intake passage 54A such that the width of the passage space is increased and such that the passage space is bent substantially perpendicularly in substantially the horizontal direction (parallel to the X-axis). The second bent passage 54C extends from an end portion of the first bent passage 54B such that the width of the passage space is maintained substantially constant and such that the passage space is bent substantially vertically downward (parallel to the Y-axis) toward the charger 4. The outlet 53 is formed at an end portion of the second bent passage 54C. The outlet 53 has a rectangular shape and has a size that is substantially the same as that of the section of the passage space 54*a* at the end portion. The width (in the longitudinal direction B) of the passage space 54*a* in the first bent passage 54B is substantially the same as that of the passage space 54*a* in the second bent passage 54C.

The opening of the inlet 52 of the air duct 51A has a substantially square shape. A connection duct 55, which connects the inlet 52 to the blower 50, is attached to the inlet 52, so that air blown by the blower 50 flows from the blower 50 to the inlet 52 of the air duct 51A (FIG. 3). The opening of the outlet 53 of the air duct 51A has an oblong shape (for example, rectangular shape) that extends parallel to a portion of the top panel 40*a* of the shield case 40 of the charger 4A surrounding the opening 43. Therefore, the openings of an inlet 52 and the outlet 53 of the air duct 51A have shapes that are different from each other. Regarding the air duct 51A, the shapes of the openings of the inlet 52 and the outlet 53 may be the same as each other or may be similar to each other (may have the same shape and different areas).

As illustrated in FIGS. 3 to 6 and other figures, the air duct 51A includes a restraining portion 56 that restrains airflow in the passage space 54*a* of the body 54. In the first exemplary embodiment, the restraining portion 56 is disposed in the first bent passage 54B of the body 54 near a position at which the first bent passage 54B is connected to the intake passage 54A. The restraining portion 56 has a gap 57 extending in a direction parallel to the longitudinal direction of the opening of the outlet 53 (which is the same as the longitudinal direction B of the charger 4A).

That is, the restraining portion 56 is formed by disposing a plate-shaped partition member 58 in the passage space 54*a* of the first bent passage 54B without changing the outer shape of the first bent passage 54B. To be specific, the partition member 58 is disposed such that the partition member 58 closes an upper part of the passage space 54*a* in the first bent passage 54B and such that the lower end of the partition member 58 is spaced apart from the bottom of the passage space 54*a* by a predetermined distance H. Thus, the gap 57 is formed in a lower part of the passage space 54*a*. The partition member 58 may be integrally formed with the duct 51A from the same material. Alternatively, the partition member 58 may be formed from a material different from that of the duct 51A.

Figure 4:
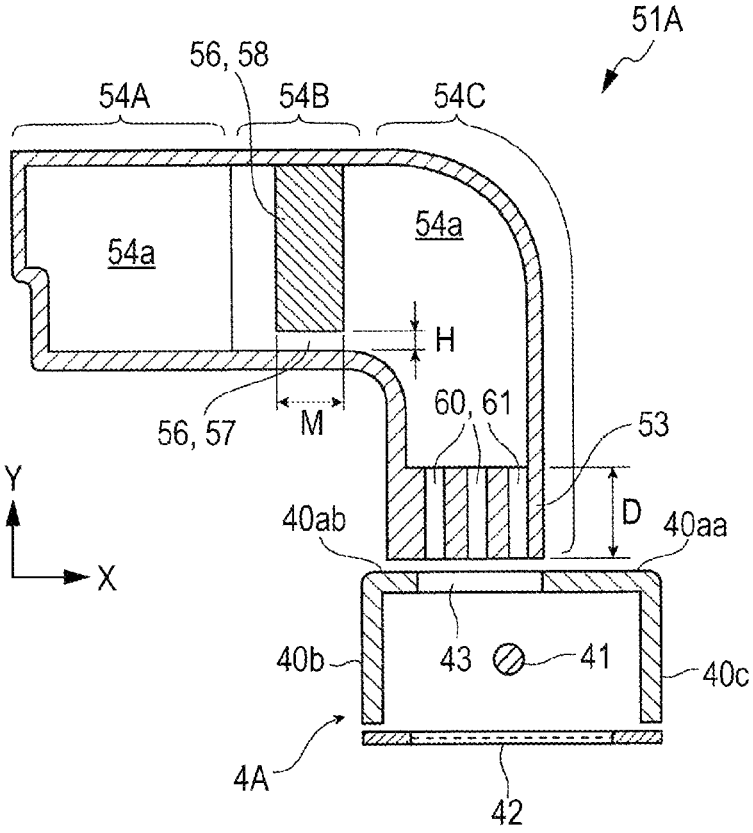
FIG. 4 is a sectional view of the blowing device (air duct) taken along line IV-IV of FIG. 3.
Figure 5:
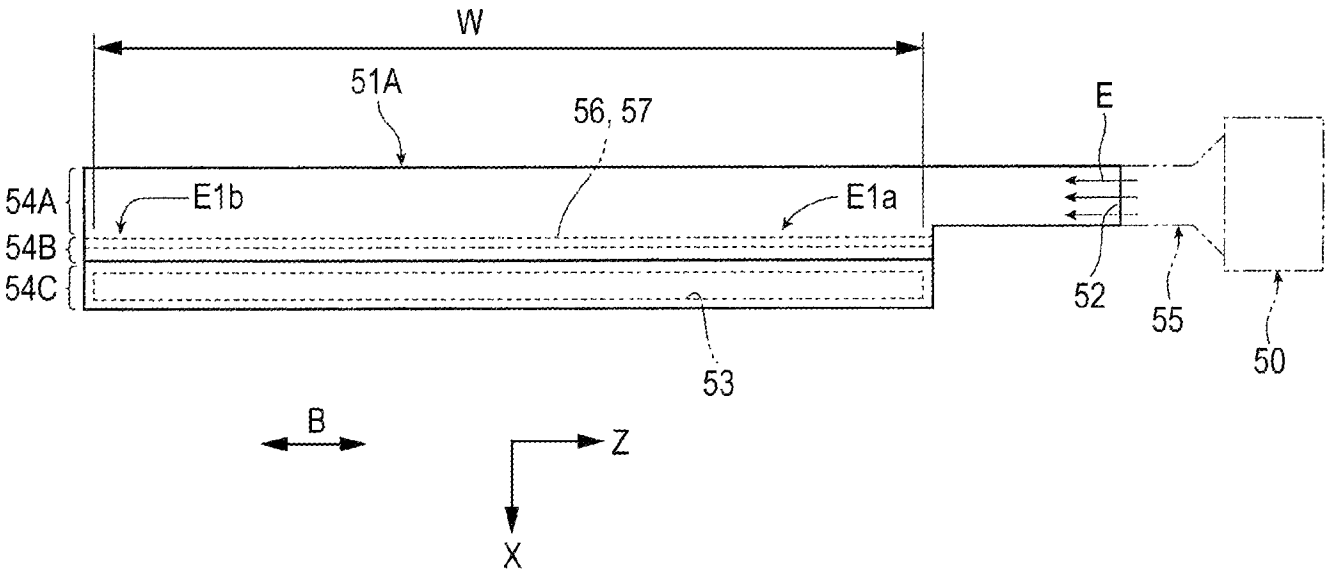
FIG. 5 is a schematic top view of the blowing device of FIG. 3.

The height H, the path length M, and the width W (length in the longitudinal direction) of the gap 57 illustrated in FIGS. 4 and 5 are determined with consideration of the following factors: to maximally uniformize the velocity of air that flows into the first bent passage 54B from the intake passage 54A, the size (volume) of the duct 51A, and the flow rate of air that needs to flow through the duct 51A or to the charger 4A. For example, the height H of the gap 57 need not be constant in the width direction, but may be uniformly or partially changed on the basis of such factors.

Figure 6:
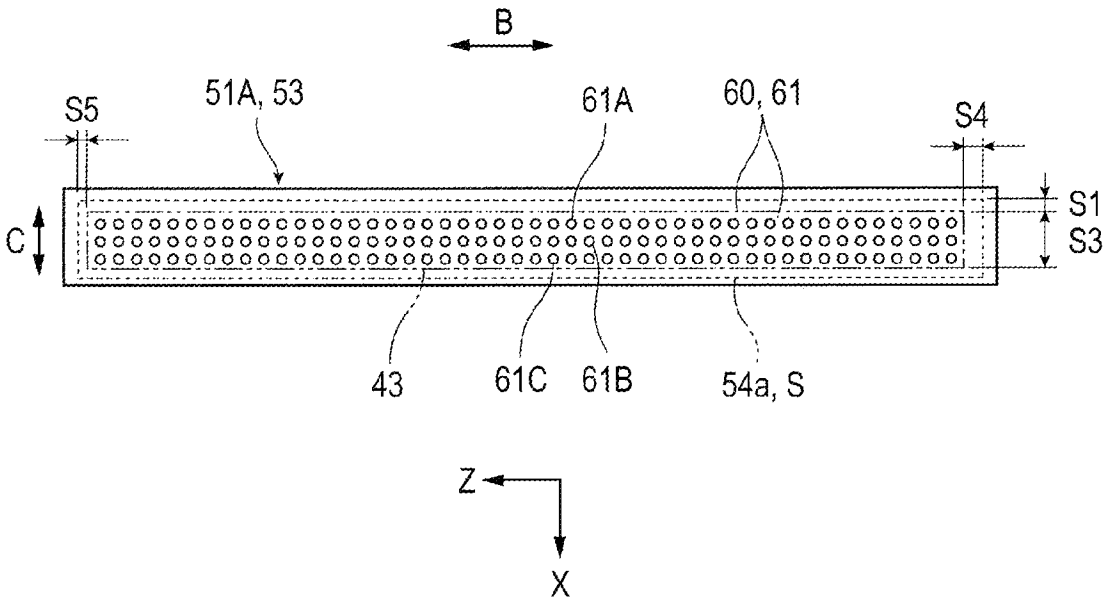
FIG. 6 is a bottom view of the air duct of the blowing device of FIG. 3, illustrating the outlet of the air duct.

As illustrated in FIGS. 4, 6, and other figures, a portion 40*ab* of the top panel 40*a* of the shield case 40, in which the opening 43 is not formed, is interposed between the outlet 53 of the air duct 51A and the discharge wire 41 and the grid electrode 42 of the charger 4A, which are target components toward which air is to be blown. The portion 40*ab* is located at a position at which the portion 40*ab* overlaps a sub-region S1 of a region S of the outlet 53.

As illustrated in FIGS. 4, 6, and other figures, a through-portion 60 is formed in a specific region S3 of the outlet 53. The specific region S3 is a part of the entire region S of the outlet 53 excluding the sub-region S1, which faces a portion 40*ab* of the shield case 40 in which the opening 43 is not formed. As illustrated in FIG. 6, to be precise, the specific region S3 is a region excluding two sub-regions S4 and S5 that are located at the ends of the outlet 53 in the longitudinal direction and that do not face the opening 43 in the shield case 40. Therefore, the specific region S3 has substantially the same shape and area as those of the opening 43 formed in the top panel 40*a* of the shield case 40.

Figure 7:
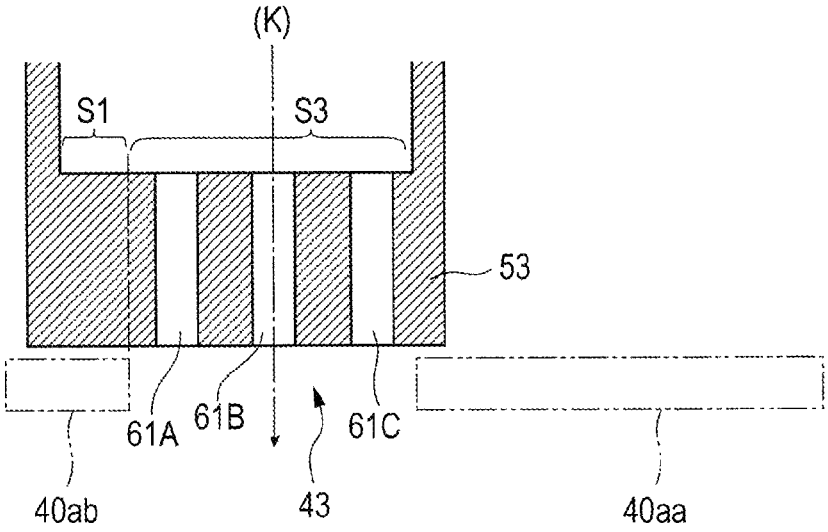
FIG. 7 is a sectional view illustrating the structure of the outlet of the air duct of FIG. 3.

As illustrated in FIGS. 6, 7, and other figures, the through-portion 60, which is formed in the specific region S3 of the outlet 53, includes plural through-holes 61 each having a circular opening and a linear cylindrical passage (air passage space surrounded by the wall of the through-hole). The through-holes 61 are arranged in three rows in the specific region S3 of the region S of the outlet 53, which has a substantially rectangular shape. In each of the three rows, the through-holes 61 are arranged linearly in the longitudinal direction B of the outlet 53 at a regular pitch. The three rows are arranged and in the transversal direction C of the outlet 53 at the same regular pitch. In FIG. 7 and other figures, the alternate long and short dash line with an arrowhead K represents a reference blowing direction in which air is blown out from the outlet 53 substantially perpendicularly toward a surface of the grid electrode 42 of the charger 4A.

That is, three rows of through-holes 61A, 61B, and 61C are arranged so as to extend in the longitudinal direction B in the specific region S3. The through-holes 61A, 61B, and 61C are the same holes formed under the same conditions. Thus, the through-holes 61 are distributed throughout the specific region S3 of the region S of the outlet 53 with a uniform density. The passages of the through-holes 61A, 61B, and 61C extend parallel to the reference blowing direction K. In the first exemplary embodiment, the reference blowing direction K is substantially perpendicular to an end surface of the second bent passage 54C, which corresponds to the entire region S of the outlet 53, or a surface of the grid electrode 42.

The through-portion 60, which includes the through-holes 61, may be obtained by forming (molding) the through-holes 61 at the same time as forming the outlet 53 from a material the same as that of the air duct 51A. Alternatively, the through-portion 60 may be obtained by attaching a member having the through-holes 61 and made from a material different from that of the duct 51A to the specific region S3 of the outlet 53. The shape and the size the opening of each the through-holes 61, the length of each of the through-holes 61, and the density of the through-holes 61 are determined with consideration of the following factors: to maximally uniformize the velocity of air that flows through the second bent passage 54C and out of the outlet 53; the size (volume) of the duct 51A; the area of the specific region S3 of the entire region S of the outlet 53, in which the through-portion 60 is formed; and an appropriate flow rate of air that needs to flow through the duct 51A or to the charger 4A. For example, fifty to two hundred through-holes 61, each having a circular opening with a diameter in the range of 0.5 to 3.0 mm and having a linear cylindrical passage, may be arranged linearly in the longitudinal direction B in a row, and one to twenty such rows may be arranged in the transversal direction C. A part of the outlet 53 in which the through-portion 60 is formed has a thickness D (FIG. 4) that is appropriate for the air passage of the through-portion 60 (through-holes 61). For example, the thickness D may be in the range of two to five times the diameter of the opening of each of the through-holes 61.

Hereinafter, the operation of the blowing device 5A will be described.

First, the blower 50 of the blowing device 5A rotates and blows an appropriate amount of air at a preset timing such as when the image forming apparatus 1 forms an image. Air E, which is blown by the blower 50, passes through the connection duct 55 and the inlet 52 of the air duct 51A, and is taken into the passage space 54*a* in the body 54 (FIG. 5).

As illustrated in FIG. 5, the air E, which has been taken into the air duct 51A, passes through the passage space 54*a* of the intake passage 54A and flows into the passage space 54*a* of the first bent passage 54B (see, for example, arrows E1*a* and E1*b* in FIG. 5). The direction of airflow is bent substantially perpendicularly from the intake passage 54A toward the first bent passage 54B, and as illustrated in FIG. 8, air E1 passes trough the gap 57 of the restraining portion 56, which is formed near the entrance of the first bent passage 54B, and flows into the second bent passage 54C (see, for example, the directions of arrows E2*a* and E2*b* in FIG. 8).

At this time, the air E1, which has flowed into the first bent passage 54B, initially become turbulent as the air E1 passes through a part of the passage space 54*a* having a nonuniform shape. However, as the air passes through the gap 57 of the restraining portion 56, the airflow becomes restrained (the pressure of the air is increased). As a result, when the air flows into the passage space 54*a* in the second bent passage 54C, the distribution of the air velocity in the longitudinal direction B of the outlet 53 is uniformized to some extent. Moreover, while the air E1 passes through the gap 57 and flows into the first bent passage 54B, the direction of airflow out of the gap 57 is aligned with a direction substantially perpendicular to the longitudinal direction B of the outlet 53. Air E2, which has flowed into the passage space 54*a* of the second bent passage 54C, is temporarily retained in the passage space 54*a* of the second bent passage 54C, which has a volume larger than that of the gap 57, and thereby nonuniformity in the velocity of the air is reduced.

Figure 8:
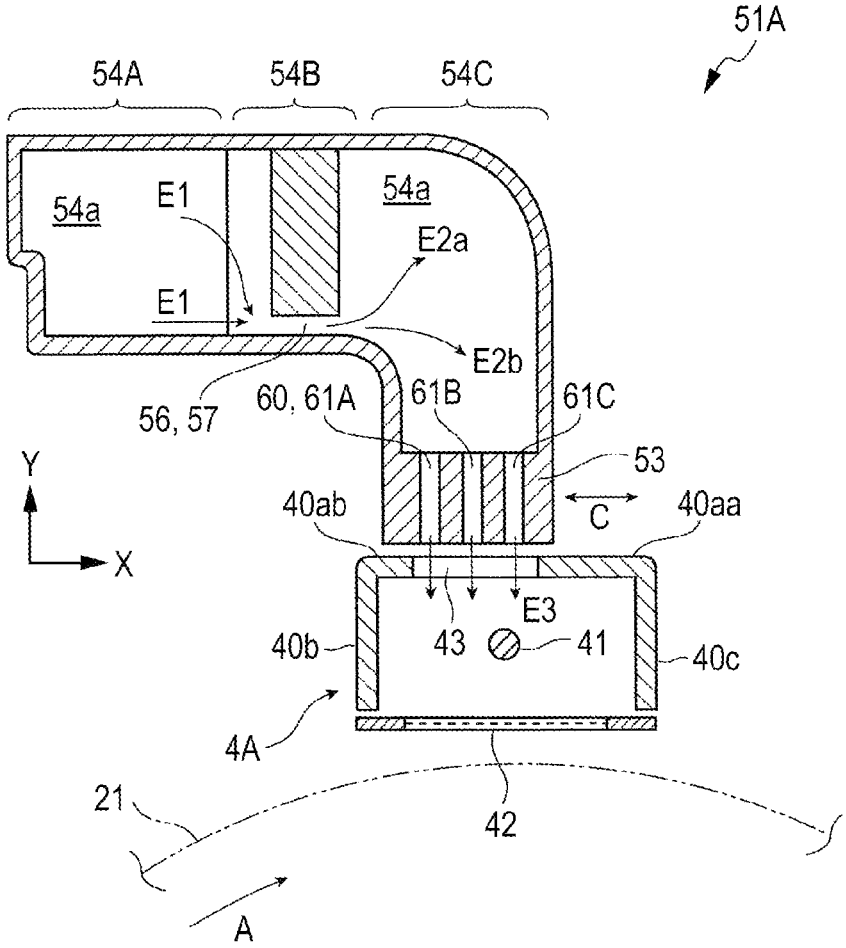
FIG. 8 illustrates the operation of the blowing device of FIG. 3.

As illustrated in FIGS. 6 and 8, the air E2, which has flowed into the second bent passage 54C, passes through the through-holes 61 as the through-portion 60, which are formed in the specific region S3 of the outlet 53 at the end of the second bent passage 54C, and the air is finally blown out from the outlet 53 (see arrows E3 in FIG. 8).

The through-holes 61 as the through-portion 60 of the outlet 53 are formed in the specific region S3. The specific region S3 is a part of the entire region S of the outlet 53 excluding at least the sub-region S1, which faces the portion 40*ab* of the top panel 40*a* of the shield case 40 in which an opening is not formed. Therefore, the air E3, which has been blown out from the outlet 53, passes through the opening 43, which is formed so as to be displaced in the top panel 40*a* of the shield case 40. The air is not blown toward the portions 40*aa* and 40*ab* of the top panel 40*a* of the shield case 40, in which the opening 43 is not formed.

The passages of the through-holes 61 have walls that extend linearly in the reference airflow direction K. Therefore, the air E3, which has been blown out from the through-holes 61, flows so that the air substantially reliably passes through the opening 43 in the shield case 40. Because the through-holes 61 are formed under the same conditions and distributed with a uniform density, the velocities of flows of air E3 that are blown out from the through-holes 61 are substantially uniform.

As illustrated in FIG. 8, the air E3, which has been blown out from the outlet 53 of the air duct 51, passes through the opening 43, which is formed so as to be displaced in the top panel 40*a* of the shield case 40 of the charger 4A, and is blown into the case 40. Finally, the air is blown toward the corona discharge wire 41, which is disposed at the center of the inner space of the case 40, and toward the grid electrode 42, which is disposed in a lower opening portion of the case 40.

The air E3, which has been blown out from the outlet 53, is not blown toward the portions 40*aa* and 40*ab* of the top panel 40*a* of the shield case 40, in which the opening 43 is not formed. Therefore, the amount of air that does not reach the corona discharge wire 41 and the grid electrode 42 and that is wasted is very small. Thus, the air E3, which has been blown out from the outlet 53, is efficiently blown toward the corona discharge wire 41 and the grid electrode 42 only with a small loss, although there are interposed components such as parts of the shield case 40.

Because the blowing device 5A blows air as described above, wastes such as paper dust, toner, toner additives, and corona by-products, which may adhere to the discharge wire 41 and the grid electrode 42, are kept away from the discharge wire 41 and the electrode 42. Moreover, wastes adhering to the wire 41 and the electrode 42 are removed. As a result, with the charger 4A, occurrence of abnormal charging such as nonuniform charging that may be caused by wastes adhering to parts of the discharge wire 41 and the grid electrode 42 is prevented, and thereby the outer peripheral surface of the photoconductor drum 21 is more uniformly charged. The image forming unit 20 including the charger 4A forms a toner image while restraining occurrence of an image defect (such as nonuniformity density), which may be caused by abnormal charging such as nonuniform charging, and finally forms a fine image on the sheet 9.

Second Exemplary Embodiment

Figure 9A:
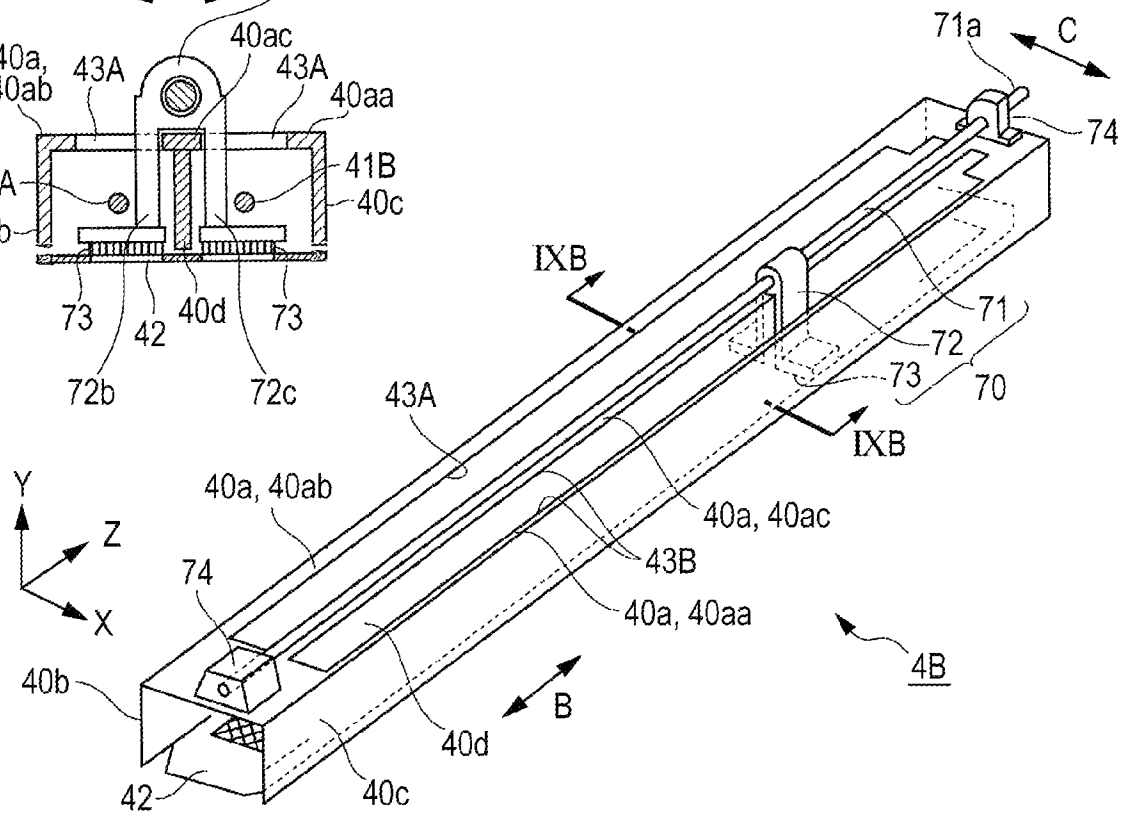
FIG. 9A is a schematic perspective view of a charger to which a blowing device according to a second exemplary embodiment is to be provided.
Figure 9B:
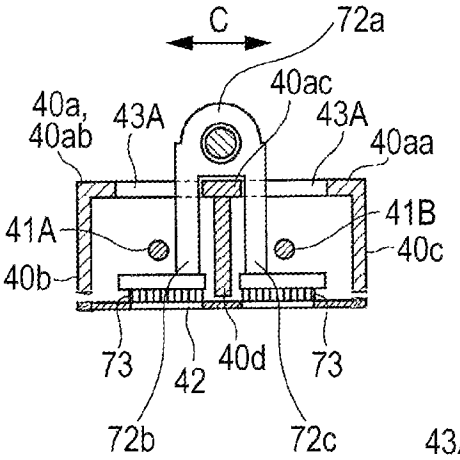
FIG. 9B is a schematic sectional view of the charger taken along line IXB-IXB of FIG. 9A.
Figure 10:
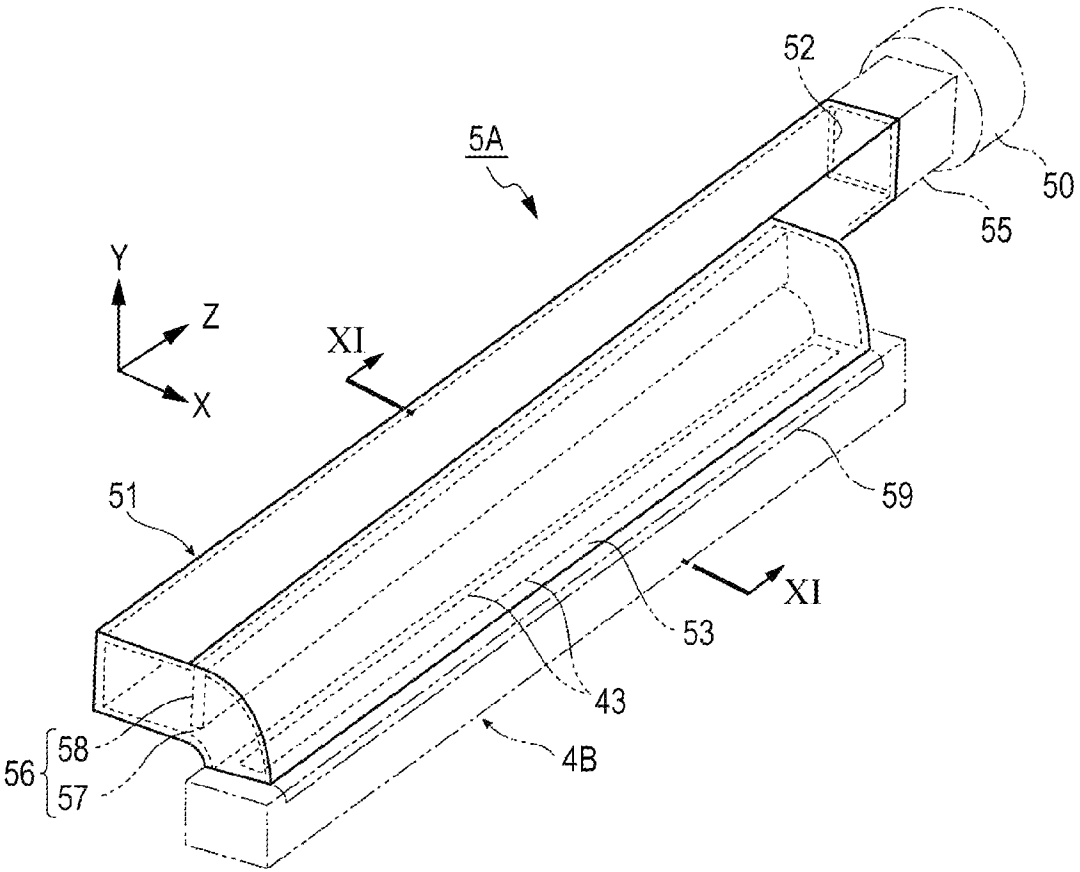
FIG. 10 is a schematic perspective view of a blowing device provided to the charger of FIG. 9.
Figure 11:
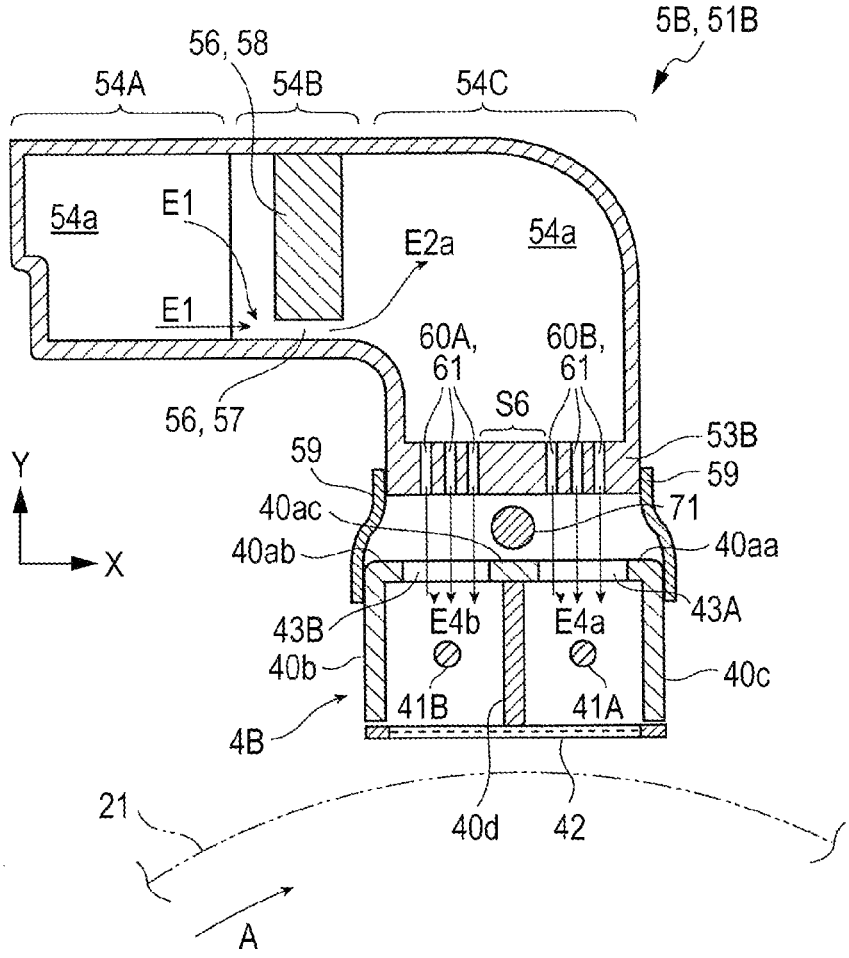
FIG. 11 is a sectional view of an air duct of the blowing device according to a second exemplary embodiment taken along line XI-XI of FIG. 10, illustrating the structure and the operation of the air duct.

FIGS. 9A to 11 illustrate parts of a blowing device according to a second exemplary embodiment. FIGS. 9A and 9B illustrate a charger to which the blowing device is to be provided, FIG. 10 schematically illustrates the blowing device, and FIG. 11 illustrates an air duct and other components of the blowing device.

As illustrated in FIG. 9, a charger 4B, to which a blowing device 5B according to the second exemplary embodiment is to be provided, differs from the charger 4A according to the first exemplary embodiment (see FIGS. 2, 4, and other figures) in that a part of the shield case 40 is changed, two corona discharge wires 41 are used, and a cleaner 70 for cleaning the grid electrode 42 is additionally provided. In other respects, the structure of the charger 4B is the same as that of the charger 4A. Therefore, in the following description and drawings, the same portions will be denoted by the same numerals and description of such portions will be omitted unless it is necessary.

In the shield case 40 of the charger 4B, a rectangular partition plate 40*d* extends in the longitudinal direction B of the charger 4B, and the partition plate 40*d* divides the inside of the case 40 into two spaces. Two corona discharge wires 41A and 41B are respectively disposed in the two spaces divided by the shield case 40. Two openings 43A and 43B are formed in the top panel 40*a* of the shield case 40 on two sides of the partition plate 40*d* in the longitudinal direction B. The openings 43A and 43B have rectangular shapes and extend in the longitudinal direction B. A middle portion 40*ac* is a part of the top panel between the two openings 43A and 43B.

A cleaner 70 of the charger 4B includes a feed guide bar 71 (rod), a movable member 72, and a cleaning member 73. The feed guide rod 71 extends above the top panel 40*a* of the shield case 40 in the longitudinal direction B. The movable member 72 reciprocates in the longitudinal direction B as the feed guide bar 71 rotates. The cleaning member 73 is disposed on a portion of the movable member 72 that faces the grid electrode 42, and the cleaning member 73 is in contact with the grid electrode 42.

The feed guide bar 71 is a threaded bar that is disposed above the middle portion 40*ac* of the top panel 40*a* of the shield case 40. The feed guide bar 71 is rotatably supported by bearings 74 that are disposed at end portions of the shield case 40 in the longitudinal direction B. An end 71*a* of the feed guide bar 71 is connected to a rotational driving device (not shown) so that a driving force is transmitted from the rotational driving device. Due to the driving force transmitted from the rotational driving device, the feed guide bar 71 may be rotated in either of two directions (the normal direction and the reverse direction).

The movable member 72 includes a support portion 72*a* and arm portions 72*b* and 72*c*. The support portion 72*a* is supported by the feed guide bar 71 extending therethrough. A driving force receiving hole, which is formed in the support portion 72*a*, meshes with the thread of the feed guide bar 71 and receives a driving force while the movable member 72 reciprocates. The arm portions 72*b* and 72*c* branch from the support portion 72*a* at the middle portion 40*ac* of the shield case and extend toward the grid electrode 42. The bottom surfaces of the arm portions 72*b* and 72*c* face a surface of the grid electrode 42 and extend substantially parallel to the surface.

The cleaning member 73 is made from, for example, a brush-like material, and the cleaning member 73 is in contact with the surface of the grid electrode 42 and is attached to the bottom of each of the arm portions 72*b* and 72*c*. The cleaning member 73 may be made from a different material as long as the cleaning member 73 is capable of contacting with a surface of the grid electrode 42 and cleaning the surface.

When the cleaner 70 is not used (for example, while charging is performed), the movable member 72 is at rest at a stand-by position. The stand-by position is a position at which the cleaning member 73 does not contact the surface of the grid electrode 42 and the movable member 72 does not hinder charging, such as an end of the shield case 40 in the longitudinal direction B. During cleaning, the feed guide bar 71 rotates alternatingly in opposite directions, and thereby the movable member 72 reciprocates in the longitudinal direction B from the stand-by position and back to the stand-by position. Thus, the cleaning member 73 reciprocates in contact with the surface of the grid electrode 42, and thereby wastes adhering to the surface are removed from the surface.

In the cleaner 70, the feed guide bar 71 extends substantially parallel to the top panel 40*a* of the shield case 40, and the feed guide bar 71 (excluding the bearings 74 and portions around the bearings 74) is located above (the middle portion 40*ac* of) the top panel 40*a* and below the outlet 53 of an air duct 51B of the blowing device 5B (see FIG. 11).

The blowing device 5B according to the second exemplary embodiment has a structure the same as that of the blowing device 5A according to the first exemplary embodiment except that a part of the outlet 53 of the air duct 51 is changed. Therefore, in the following description and drawings, the same portions will be denoted by the same numerals and description of such portions will be omitted unless it is necessary.

Figure 13:
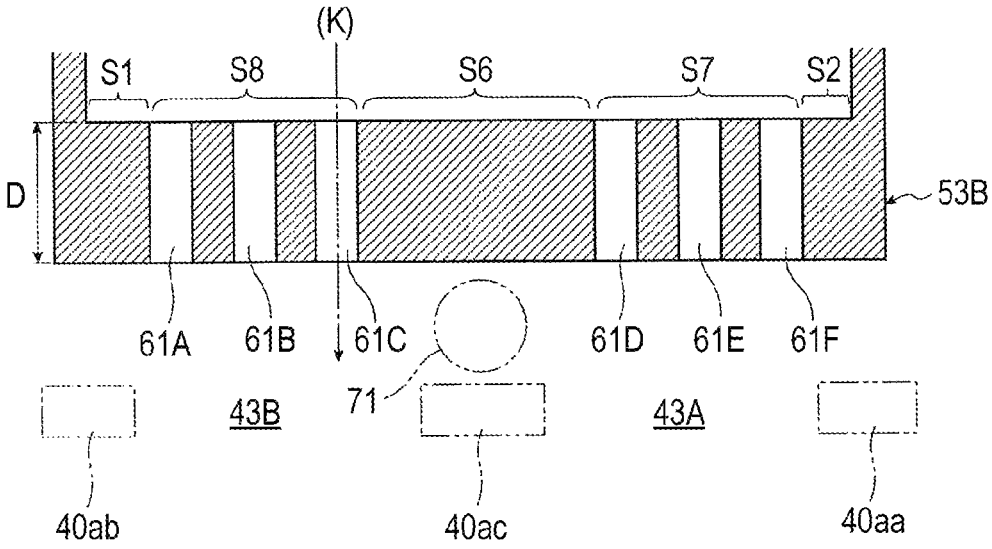
FIG. 13 is a sectional view illustrating the structure of the outlet of the air duct of FIG. 10.

As illustrated in FIGS. 11 and 13, in the air duct 51B of the blowing device 5B, the portions 40*aa* and 40*ab* (unopened portions) of the top panel 40*a* of the shield case 40, in which the openings 43A and 43B are not formed, and the feed guide bar 71 of the cleaner 70 are interposed between an outlet 53B and the two discharge wires 41A and 41B and the grid electrode 42 of the charger 4B, toward which air is to be blown, at positions that overlap sub-regions S1, S2, and S6 of the region S of the outlet 53B. The guide bar 71 is disposed so as to overlap the middle portion 40*ac* of the top panel 40*a* in which the openings 43A and 43B are not formed.

Figure 12:
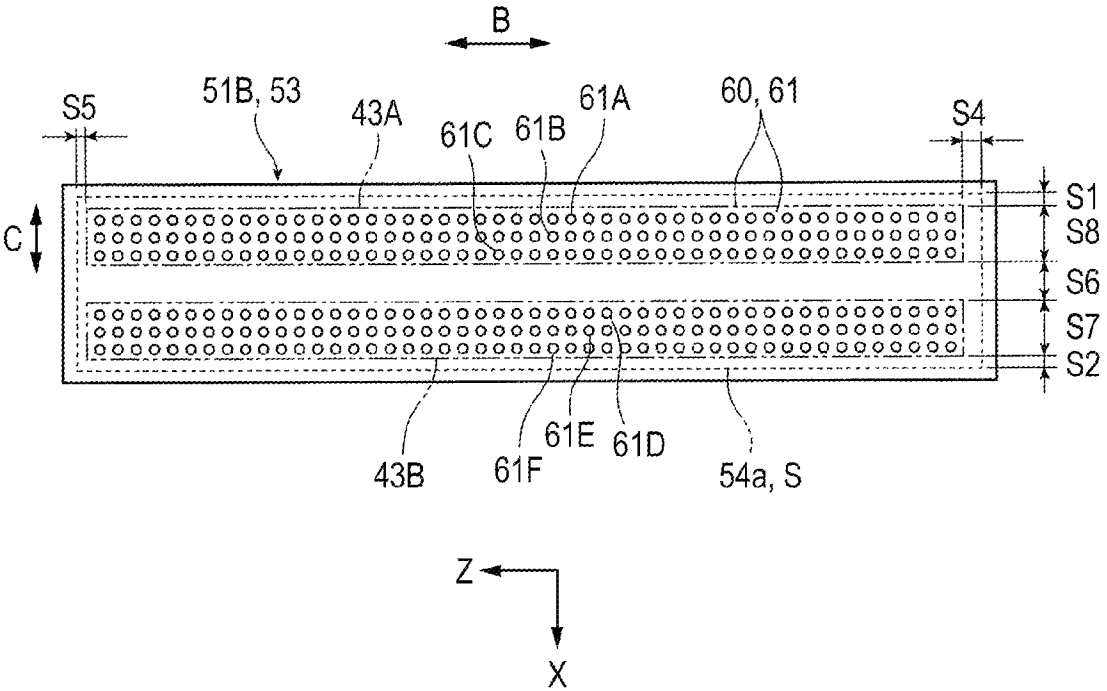
FIG. 12 is a bottom view of the air duct of the blowing device of FIG. 11, illustrating the outlet of the air duct.

As illustrated in FIGS. 12 and 13, the outlet 53 of the air duct 51B includes through-portions 60A and 60B that are respectively formed in specific regions S7 and S8. The specific regions S7 and S8 are parts of the entire region S (which substantially faces the entire surface of the top panel 40*a* of the shield case 40) excluding the sub-regions S1, S2, and S6, which respectively face the portions 40*ab* and 40*aa* of the shield case 40 and the feed guide bar 71 (the middle portion 40*ac*). To be precise, as in the case of the first exemplary embodiment, the specific regions S7 and S8 are regions excluding two sub-regions S4 and S5 at the ends of the outlet 53 that do not face the openings 43A and 43B in the shield case 40 (FIG. 12). Therefore, the specific regions S7 and S8 have substantially the same shapes and areas as those of the two openings 43A and 43B formed in the top panel 40*a* of the shield case 40. As illustrated in FIG. 11, a connection covering member 59 covers a gap between the outlet 53B of the air duct 51B and the top panel 40*a* of the shield case 40 and prevents leakage of air, which is blown out from the outlet 53, from the gap.

As illustrated in FIGS. 11 to 13, the through-portions 60A and 60B, which are respectively formed in the specific regions S7 and S8 of the outlet 53, each include the plural through-holes 61 each having a circular opening and a linear cylindrical passage, as with the through-holes 61 of the through-portion 60 of the first exemplary embodiment. The through-holes 61 are arranged in three rows in the transversal direction C of the outlet 53 at a regular pitch in each of the through-portions 60A and 60B in the specific regions S7 and S8 of the region S of the outlet 53 having rectangular shapes. In each of the three rows, the through-holes 61 are arranged linearly in the longitudinal direction B at a regular pitch. The three rows are arranged and in the transversal direction C of the outlet 53 at the same regular pitch.

That is, in the specific regions S7 and S8, three rows of through-holes 61A, 61B, and 61C and three rows of through-holes 61D, 61E, and 61F extend in the longitudinal direction B (see FIG. 12). The through-holes 61A to 61F are the same holes formed under the same conditions. Thus, the plural through-holes 61 are distributed throughout the specific regions S7 and S8 of the region S of the outlet 53 with a uniform density. The passages of the through-holes 61A to 61F extend parallel to the reference blowing direction K.

Hereinafter, the operation of the blowing device 5B will be described.

First, the blower 50 of the blowing device 5B rotates and blows an appropriate amount of air at a preset timing such as when the image forming apparatus 1 forms an image. As in the case of the blowing device 5A according to the first exemplary embodiment, air E, which is blown by the blower 50, passes through the connection duct 55 and is taken into the passage space 54*a* in the body 54 through the inlet 52 of the air duct 51B. Then, the air E passes through the passage space 54*a* of the intake passage 54A and flows into the passage space 54*a* of the first bent passage 54B (see, for example, arrows E1*a* and E1*b* in FIG. 5). Subsequently, the air E flows into the second bent passage 54C (see the direction of arrow E2*a* in FIG. 11). As in the case of the air duct 51 according to the first exemplary embodiment, air E1, which has flowed into the first bent passage 54B, passes through the gap 57 of the restraining portion 56.

As illustrated in FIGS. 11 and 13, air E2, which has flowed into the second bent passage 54C, passes through the through-holes 61 as the through-portions 60A and 60B, which are formed in the specific regions S7 and S8 of the outlet 53B at an end of the second bent passage 54C, and is blown out from the outlet 53B (see arrows E4*a* and E4*b* in FIG. 11).

As described above, the through-holes 61 in the through-portions 60A and 60B of the outlet 53B are formed in the specific regions S7 and S8. The specific regions S7 and S8 are parts of the entire region S of the outlet 53B excluding at least the sub-regions S1, S2, and S6, respectively facing the portions 40*ab* and 40*aa* of the top panel 40*a* of the shield case 40, in which the opening 43 is not formed, and the feed guide bar 71 of the cleaner 70. Therefore, two flows of air E4*a* and E4*b* blown out from the outlet 53B respectively passes through the two openings 43A and 43B formed in the top panel 40*a* of the shield case 40. The air is not blown toward the portions 40*aa* and 40*ab* (including the middle portion 40*ac*) of the top panel 40*a* of the shield case 40, in which the opening 43 is not formed, and the feed guide bar 71 of the cleaner 70.

The passages of the through-holes 61 in the through-portions 60A and 60B have walls that extend linearly in the reference airflow direction K. Therefore, the flows of air E4*a* and E4*b*, which have been blown out from the through-holes 61, move so that the flows of air reliably pass through the two openings 43A and 43B in the shield case 40. Because the through-holes 61 are formed under the same conditions and distributed throughout the through-portions 60A and 60B with a uniform density, the velocities of flows of air E4*a* and E4*b* that are blown out from the through-holes 61 are substantially uniform.

As illustrated in FIG. 11, the flows of air E4*a* and E4*b*, which have been blown out from the outlet 53B of the air duct 51B, pass through the two openings 43A and 43B, which are formed so as to be separated from each other in the top panel 40*a* of the shield case 40 of the charger 4B, and are blown into the case 40. Finally, the air is blown toward the corona discharge wires 41A and 41B, which are respectively disposed at the centers of the two divided spaces inside the case 40, and toward the grid electrode 42, which is disposed in a lower opening portion of the case 40.

The flows of air E4*a* and E4*b*, which have been blown out from the outlet 53B, are not blown toward the portions 40*aa* and 40*ab* (including the middle portion 40*ac*) of the top panel 40*a* of the shield case 40, in which the openings 43A and 43B are not formed, and the feed guide bar 71 of the cleaner 70. Therefore, the amount of air that does not reach the two corona discharge wires 41A and 41B and the grid electrode 42 and that is wasted is very small. Thus, the flows of air E4*a* and E4*b*, which have been blown out from the outlet 53B, are efficiently blown toward the two corona discharge wires 41A and 41B and the grid electrode 42 only with a small loss, although there are interposed components such as parts of the shield case 40 and the feed guide bar 71 of the cleaner 70.

Because the blowing device 5B blows air as described above, wastes described above, which may adhere to the two discharge wires 41A and 41B and the grid electrode 42, are kept away from the wires 41A and 41B and the electrode 42. Moreover, wastes adhering to the wires 41A and 41B and the electrode 42 are removed. As a result, occurrence of abnormal charging such as nonuniform charging that may be caused by wastes adhering to parts of the discharge wires 41A and 41B and the grid electrode 42 of the charger 4B is prevented, and thereby the outer peripheral surface of the photoconductor drum 21 is more uniformly charged. The image forming unit 20 including the charger 4B forms a toner image while restraining occurrence of an image defect due to abnormal charging such as nonuniform charging and finally forms a fine image on the sheet 9.

Third Exemplary Embodiment

Figure 14:
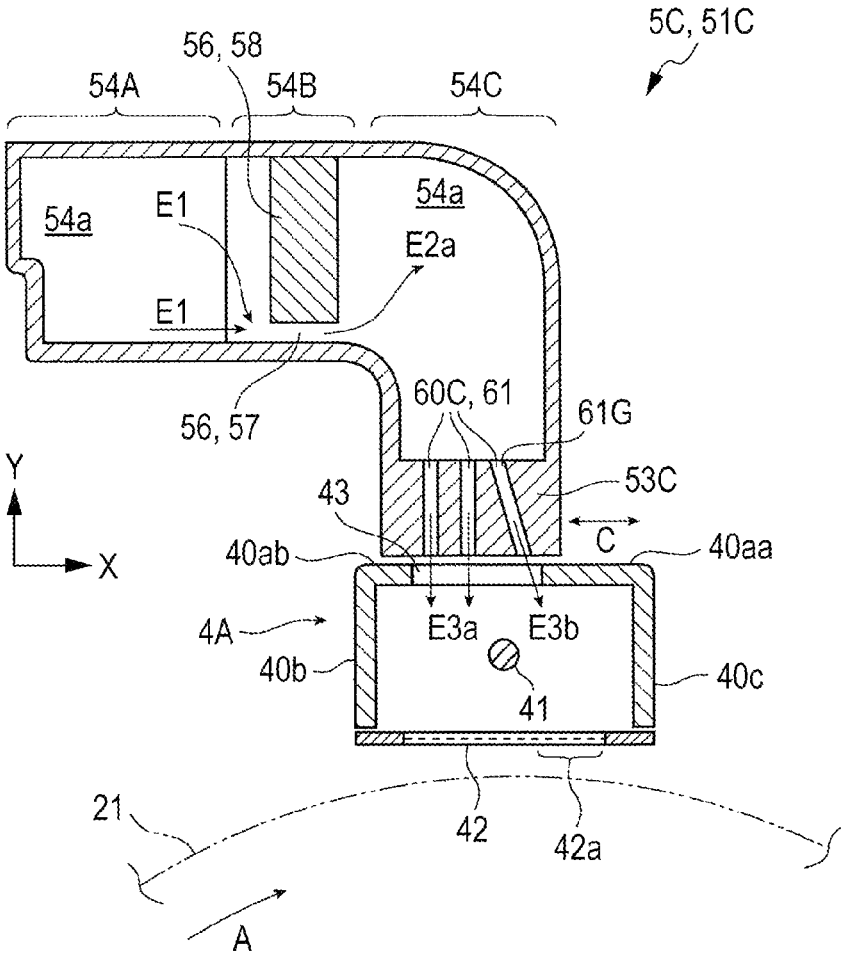
FIG. 14 is a sectional view of an air duct of the blowing device according to a third exemplary embodiment, illustrating the structure and the operation of the air duct.

FIG. 14 illustrates a part (air duct) of a blowing device according to a third exemplary embodiment. As illustrated in FIG. 14, a blowing device 5C according to the third exemplary embodiment differs from the blowing device 5A according to the first exemplary embodiment in that a part of the outlet 53 of the air duct 51 is changed. In other respects, the structure of the blowing device 5C is the same as that of the blowing device 5A. Therefore, in the following description and drawings, the same portions will be denoted by the same numerals and description of such portions will be omitted unless it is necessary. The blowing device 5C is provided to a charger that is the same as the charger 4A according to the first exemplary embodiment.

Figure 15:
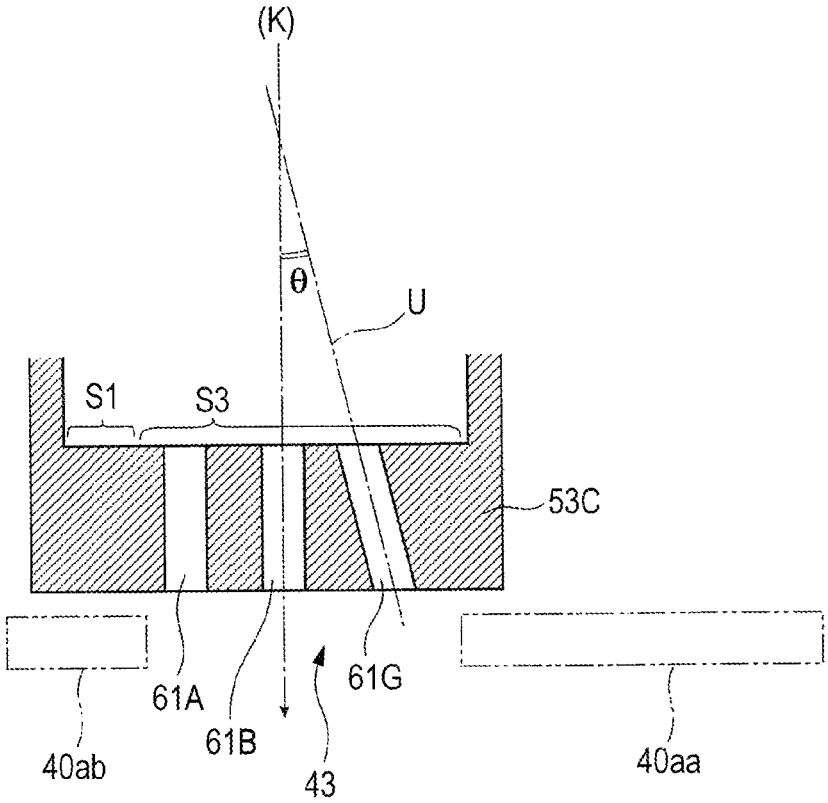
FIG. 15 is a sectional view illustrating the structure of the outlet of the air duct of FIG. 14.

As illustrated in FIGS. 14 and 15, an air duct 51C of the blowing device 5C includes a through-portion 60C that is formed in a specific region S3 of an outlet 53C. The specific region S3 is a part of the entire region S of the outlet 53C excluding at least the sub-region S1, which faces the portion 40*ab* of the shield case 40 in which the opening 43 is not formed. In the through-portion 60C in the specific region S3 of the outlet 53, three rows of through-holes 61A, 61B, and 61G extend in the longitudinal direction B (FIG. 6). Among the three rows of through-holes 61A, 61B, and 61G of the through-portion 60C, the through-holes 61G are formed near the center of the specific region S3 of the outlet 53 in the transversal direction C (a right end portion of S3 in FIG. 15). The through-holes 61G are formed as air passages that are inclined with respect to the reference airflow direction K. On the other hand, the through-holes 61A and 61B of the through-portion 60C extend substantially parallel to (uninclined with respect to) the reference airflow direction K, as with the through-holes 61A and 61B of the outlet 53 according to the first exemplary embodiment. The through-holes 61A, 61B, and 61G have circular openings with the same diameter and linear cylindrical passages.

As illustrated in FIG. 14, when seen in the reference airflow direction K from the outlet 53C side, the passages of the through holes 61G are inclined so that the passages are directed toward a portion 42*a* of the grid electrode 42, to which air is to be blown, that is shielded by the portion 40*aa* of the shield case 40, in which the opening 43 is not formed. The angle θ (inclination) between the direction U (represented by alternate long and short dash line in FIG. 15) of the passages of the inclined through-holes 61G and the reference airflow direction K is determined in accordance with, for example, the following factors: the distance between the outlet 53C and the top panel 40*a* of the shield case 40, the positional relationship between the outlet 53C and the opening 43 in the top panel 40*a*, and the positional relationship between the opening 43 in the top panel 40*a* and the shielded portion 42*a*.

Hereinafter, the operation of the blowing device 5C will be described.

The blower 50 of the blowing device 5C blows air E at a preset timing such as when the image forming apparatus 1 forms an image. As in the case of the blowing device 5A according to the first exemplary embodiment, the air passes through the connection duct 55 and the inlet 52 of the air duct 51C, and is taken into the passage space 54*a* in the body 54. Then, the air passes through the passage space 54*a* of the intake passage 54A and flows into the passage space 54*a* of the first bent passage 54B (see, for example, arrows E1*a* and E1*b* in FIG. 5). Subsequently, the air flows into the second bent passage 54C (see, for example, the direction of arrow E2*a* in FIG. 14). At this time, air E1, which has flowed into the first bent passage 54B, passes through the gap 57 of the restraining portion 56 as in the case of the air duct 51 according to the first exemplary embodiment.

As illustrated in FIGS. 14 and 15, air E2, which has flowed into the second bent passage 54C, passes through the through-holes 61 (61A, 61B, and 61G) as the through-portion 60C, which are formed in the specific region S3 of the outlet 53C at the end of the second bent passage 54C, and is blown out from the outlet 53C (see arrows E3*a* and E3*b* in FIG. 14).

As described above, the through-holes 61 of the through-portion 60C of the outlet 53C are formed in the specific region S3. The specific region S3 is a part of the entire region S of the outlet 53 excluding at least the sub-regions S1 and S2, which respectively face the portions 40*aa* and 40*ab* of the top panel 40*a* of the shield case 40 in which the opening 43 is not formed. Therefore, flows of air E3*a* and E3*b*, which have been blown out from the outlet 53C, pass through the opening 43 formed in the top panel 40*a* of the shield case 40. The air is not blown toward the portions 40*aa* and 40*ab* of the top panel 40*a* of the shield case 40, in which the opening 43 is not formed.

Moreover, among the through-holes 61 in the through-portion 60C, the passages of (the rows of) the through-holes 61A and 61B have walls that extend linearly in the reference airflow direction K. Therefore, the air E3*a*, which has been blown out from the through-holes 61A and 61B, flows so that the air reliably passes through the opening 43 in the shield case 40. On the other hand, among the through-holes 61 in the through-portion 60C, the passages of (the row of) the through-holes 61G has walls that are inclined at the angle θ with respect to the reference airflow direction K. Therefore, air E3*b*, which has been blown out from the through-holes 61G, flows in a direction having the angle θ with respect to the reference airflow direction K, passes through the opening 43 in the shield case 40, and then flows diagonally in the case 40. Thus, the air E3*b*, which has been blown out from the inclined through-holes 61G, reaches the portion 42*a* of the grid electrode, which is shielded by the portion 40*aa* of the top panel of the shield case 40 in which the opening 43 is not formed.

As illustrated in FIG. 14, the flows of air E3*a* and E3*b*, which have been blown out from the outlet 53C of the air duct 51C, pass through the opening 43, which is formed so as to be displaced in the top panel 40*a* of the shield case 40 of the charger 4A, and is blown into the case 40. Finally, the air are blown toward the corona discharge wire 41, which is disposed at the center of the space inside the case 40, and toward the grid electrode 42, which is disposed in a lower opening portion of the case 40.

The flows of air E3*a* and E3*b*, which have been blown out from the outlet 53C, are not blown toward the portions 40*aa* and 40*ab* of the top panel 40*a* of the shield case 40, in which the opening 43 is not formed. Therefore, the amount of air that does not reach the corona discharge wire 41 and the grid electrode 42 and that is wasted is very small. Moreover, the air E3*b*, which has been blown out from the inclined through-holes 61G, reaches the portion 42*a* of the grid electrode, which is shielded by the portion 40*aa* of the top panel of the shield case 40 in which the opening 43 is not formed.

Thus, the flows of air E3*a* and E3*b*, which have been blown out from the outlet 53C, are efficiently blown toward the corona discharge wire 41 and the grid electrode 42 only with a small loss, although there are interposed components such as parts of the shield case 40. Moreover, the air is also efficiently blown toward the portion 42*a* of the grid electrode 42, which is shielded by the interposed components.

In particular, with the blowing device 5C, wastes are more effectively prevented from adhering to the entire region of the grid electrode 42 (in particular, in the transversal direction C). Therefore, the photoconductor drum 21 is more uniformly charged in the rotation direction A (process direction). As a result, occurrence of nonuniform charging in the process direction and forming of a nonuniform image due to the nonuniform charged are reliably prevented.

Fourth Exemplary Embodiment

Figure 16:
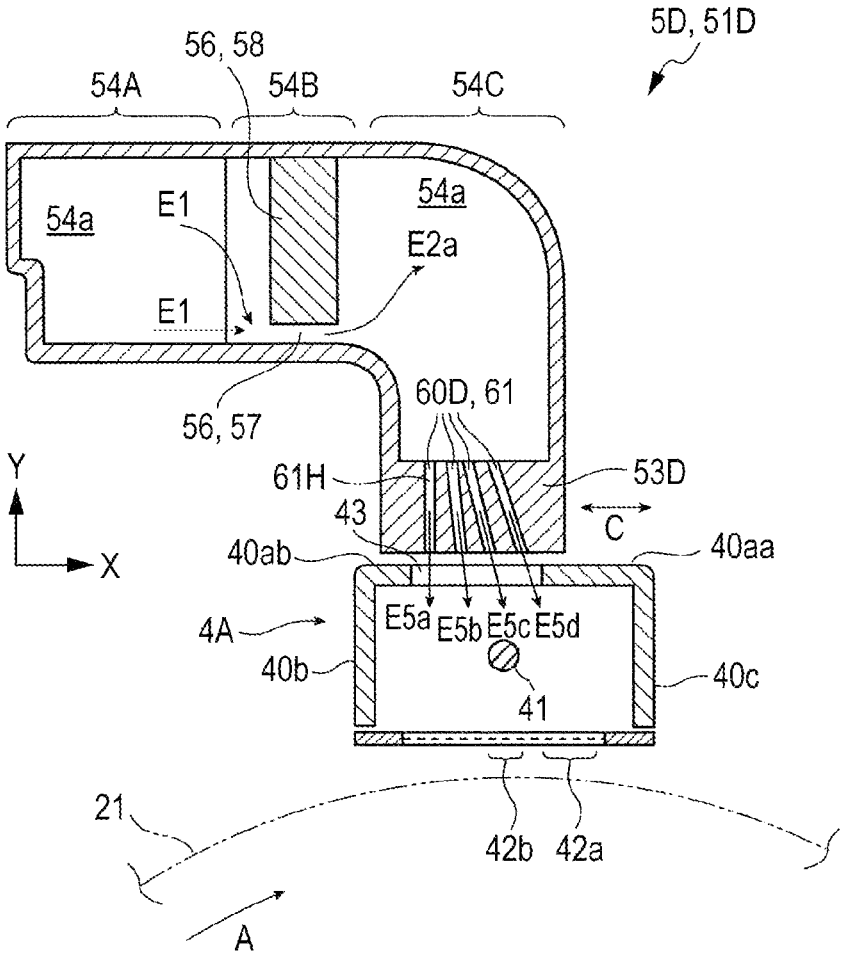
FIG. 16 is a sectional view of an air duct of the blowing device according to a fourth exemplary embodiment, illustrating the structure and the operation of the air duct.

FIG. 16 illustrates a part (air duct) of a blowing device according to a fourth exemplary embodiment. As illustrated in FIG. 16, a blowing device 5D according to the fourth exemplary embodiment differs from the blowing device 5A according to the first exemplary embodiment in that a part of the outlet 53 of the air duct 51 is changed. In other respects, the structure of the blowing device 5D is the same as that of the blowing device 5A. Therefore, in the following description and drawings, the same portions will be denoted by the same numerals and description of such portions will be omitted unless it is necessary. The blowing device 5D is provided to a charger that is the same as the charger 4A according to the first exemplary embodiment.

Figure 17:
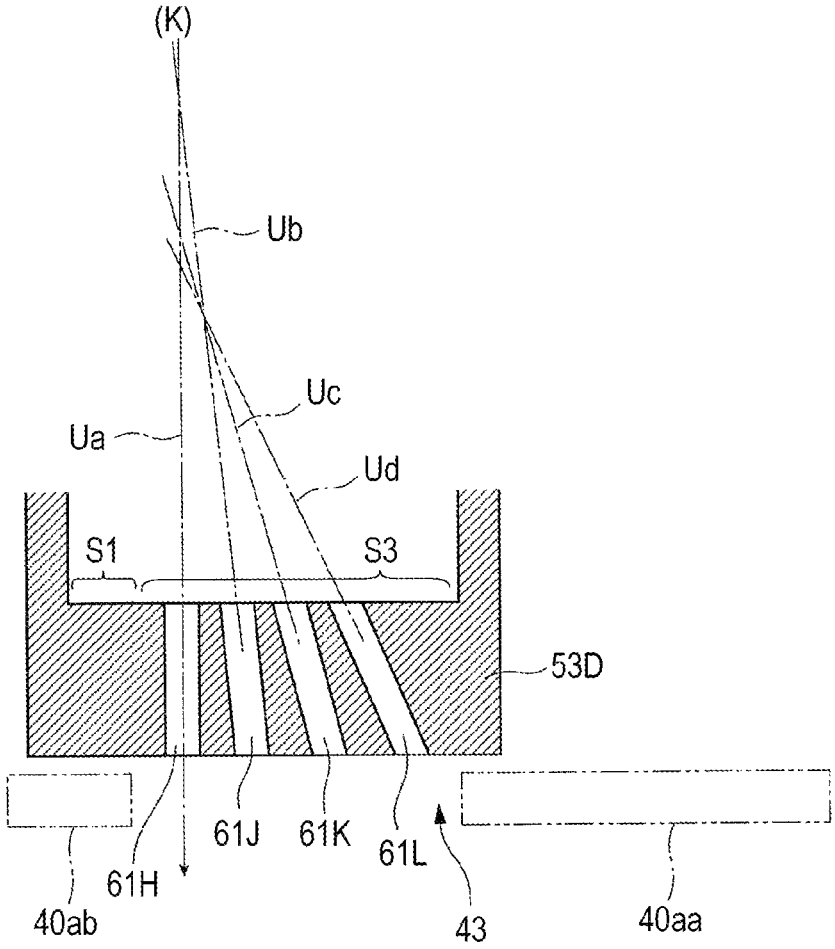
FIG. 17 is a sectional view illustrating the structure of the outlet of the air duct of FIG. 16.

As illustrated in FIGS. 16 and 17, an air duct 51D of the blowing device 5D includes a through-portion 60D that is formed in a specific region S3 of an outlet 53D. The specific region S3 is a part of the entire region S of the outlet 53D excluding at least the sub-region S1, which faces the portion 40*ab* of the top panel 40*a* of the shield case 40 in which the opening 43 is not formed. In the through-portion 60D in the specific region S3 of the outlet 53D, four rows of through-holes 61H, 61J, 61K, and 61L extend in the longitudinal direction B, and the four rows are arranged in the transversal direction C.

Among the four rows of through-holes 61H, 61J, 61K, and 61L of the through-portion 60D, the through-holes 61J, 61K, and 61L, are formed in a region of the outlet 53D excluding an end portion of the specific region S3 that is farther from the center of the outlet 53D in the transversal direction C (a left end portion of the region S3 in FIG. 17). The through-holes 61J, 61K, and 61L are formed as air passages that are inclined at different predetermined angles with respect to the reference airflow direction K. On the other hand, the through-holes 61H of the through-portion 60D are formed in the end portion of the specific region S3 that is farther from the center of the outlet 53D. The through-holes 61H extend substantially parallel to (uninclined with respect to) the reference airflow direction K, as with the through-holes 61A of the outlet 53 according to the first exemplary embodiment. The through-holes 61H, 61J, 61K, and 61L have circular openings with the same diameter and linear cylindrical passages.

As illustrated in FIG. 16, when seen in the reference airflow direction K from the outlet 53D side, the passages of the through-holes 61J, 61K, and 61L are inclined so that the passages are directed with different (increasing) angles toward the portion 42*a* of the grid electrode 42, to which air is to be blown, that is shielded by the portion 40*aa* of the shield case 40, in which the opening 43 is not formed, and toward a portion 42*b* of the grid electrode 42 that is shielded by the discharge wire 41. The angles (inclinations) between the directions Ub, Uc, and Ud of the passages of the inclined through-holes 61J, 61K, and 61L and the reference airflow direction K are determined in accordance with, for example, the following factors: the distance between the outlet 53D and the top panel 40*a* of the shield case 40, the positional relationship between the outlet 53D and the opening 43 in the top panel 40*a*, and the positional relationship between the opening 43 in the top panel 40*a* and the shielded portions 42*a* and 42*b*.

Hereinafter, the operation of the blowing device 5D will be described.

The blower 50 of the blowing device 5D blows air E at a preset timing such as when the image forming apparatus 1 forms an image. As in the case of the blowing device 5A according to the first exemplary embodiment, the air passes through the connection duct 55 and the inlet 52 of the air duct 51D, and is taken into the passage space 54*a* in the body 54. Then, the air passes through the passage space 54*a* of the intake passage 54A and flows into the passage space 54*a* of the first bent passage 54B (see, for example, arrows E1*a* and E1*b* in FIG. 5). Subsequently, the air flows into the second bent passage 54C (see, for example, the direction of arrow E2*a* in FIG. 16). At this time, air E1, which has flowed into the first bent passage 54B, passes through the gap 57 of the restraining portion 56 as in the case of the air duct 51 according to the first exemplary embodiment.

As illustrated in FIG. 16, air E2, which has flowed into the second bent passage 54C, passes through the through-holes 61 (61H, 61J, 61K, and 61L) as the through-portion 60D, which are formed in the specific region S3 of the outlet 53D at the end of the second bent passage 54C, and is blown out from the outlet 53D (see arrows E5*a*, E5*b*, E5*c*, and E5*d* in FIG. 16).

As described above, the through-holes 61 of the through-portion 60D of the outlet 53D are formed in the specific region S3 of the entire region S of the outlet 53D. Therefore, flows of air E5*a*, E5*b*, E5*c*, and E5*d*, which have been blown out from the outlet 53D, pass the opening 43 formed in the top panel 40*a* of the shield case 40. The air is not blown toward the portions 40*aa* and 40*ab* of the top panel 40*a* of the shield case 40, in which the opening 43 is not formed.

Moreover, among the through-holes 61 in the through-portion 60D, the passages of (the row of) the through-holes 61H have walls that extend linearly in the reference airflow direction K. Therefore, the air E5*a*, which has been blown out from the through-holes 61H, flows so that the air reliably passes through the opening 43 in the shield case 40. On the other hand, among the through-holes 61 in the through-portion 60D, the passages of (the rows of) the through-holes 61J, 61K, and 61L have walls that are inclined at different angles with respect to the reference airflow direction K. Therefore, the flows of air E5*b*, E5*c*, and E5*d*, which have been blown out from the through-holes 61J, 61K, and 61L, move in directions having different angles with respect to the reference airflow direction K, pass through the opening 43 in the shield case 40, and then move diagonally in the case 40. Thus, the flows of air E5*b*, E5*c*, and E5*d*, which have been blown out from the gradually inclined through-holes 61, reach the portions 42*a* and 42*b* of the grid electrode, which are respectively shielded by the portion 40*aa* of the top panel of the shield case 40 in which the opening 43 is not formed and by the discharge wire 41.

As illustrated in FIG. 16, the flows of air E5*a*, E5*b*, E5*c*, and E5*d*, which have been blown out from the outlet 53D of the air duct 51D, pass through the opening 43, which is formed so as to be displaced in the top panel 40*a* of the shield case 40 of the charger 4A, and is blown into the case 40. Finally, the air is blown toward the corona discharge wire 41, which is disposed at the center of the space inside the case 40, and the grid electrode 42, which is disposed in a lower opening portion of the case 40.

The flows of air E5*a*, E5*b*, E5*c*, and E5*d*, which have been blown out from the outlet 53D, are not blown toward the portions 40*aa* and 40*ab* of the top panel 40*a* of the shield case 40, in which the opening 43 is not formed. Therefore, the amount of air that does not reach the corona discharge wire 41 and the grid electrode 42 and that is wasted is very small. Moreover, the flows of air E5*b*, E5*c*, and E5*d*, which have been blown out from the inclined through-holes 61J, 61K, and 61L, reach the portions 42*a* and 42*b* of the grid electrode, which is shielded by the portion 40*aa* of the top panel of the shield case 40, in which the opening 43 is not formed, and the discharge wire 41.

Thus, the flows of air E5*a*, E5*b*, E5*c*, and E5*d*, which have been blown out from the outlet 53D, are efficiently blown toward the corona discharge wire 41 and the grid electrode 42 only with a small loss, although there are interposed components such as parts of the shield case 40 and the discharge wire 41. Moreover, the air is also efficiently blown toward the portions 42*a* and 42*b* of the grid electrode 42, which is shielded by the interposed components.

With the blowing device 5D, wastes are more effectively prevented from adhering to the entire region of the grid electrode 42 (in particular, in the transversal direction C) than with the blowing device 5C according to the third exemplary embodiment. Therefore, the photoconductor drum 21 is more uniformly charged in the rotation direction A (process direction) than with the blowing device 5C. As a result, occurrence of nonuniform charging in the process direction and forming of a nonuniform image due to the nonuniform charging are more reliably prevented.

Fifth Exemplary Embodiment

Figure 18:
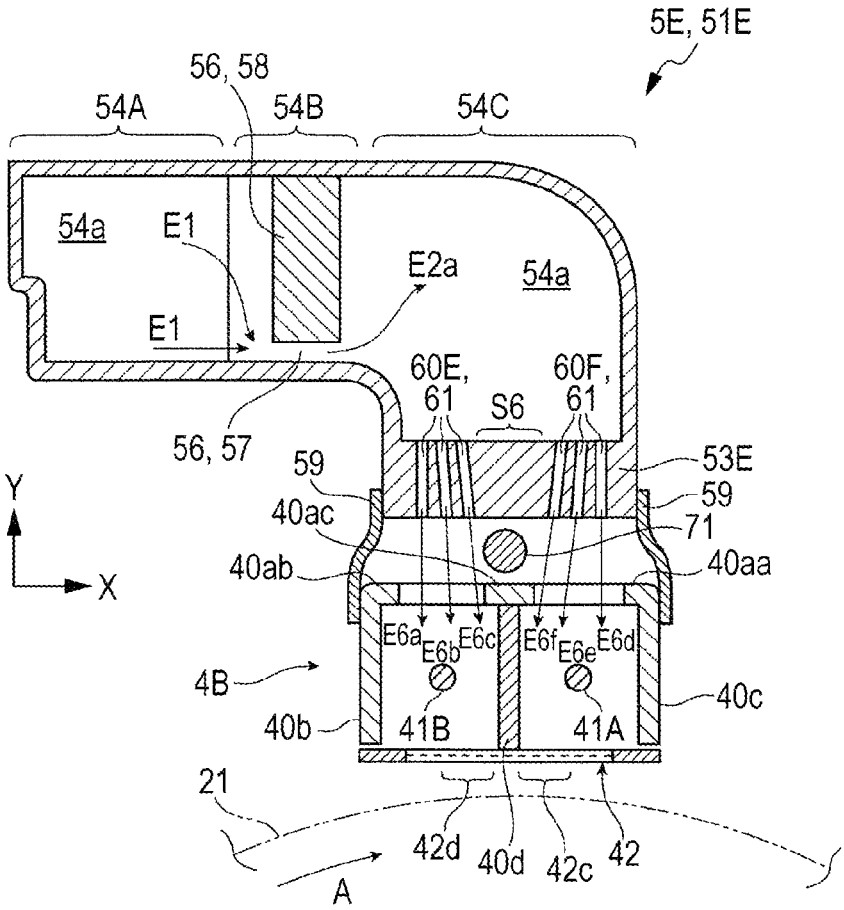
FIG. 18 is a sectional view of an air duct of the blowing device according to a fifth exemplary embodiment, illustrating the structure and the operation of the air duct.

FIG. 18 illustrates a part (air duct) of a blowing device according to a fifth exemplary embodiment. As illustrated in FIG. 18, a blowing device 5E according to the fifth exemplary embodiment differs from the blowing device 5A according to the first exemplary embodiment in that a part of the outlet 53 of the air duct 51 is changed. In other respects, the structure of the blowing device 5E is the same as that of the blowing device 5A. Therefore, in the following description and drawings, the same portions will be denoted by the same numerals and description of such portions will be omitted unless it is necessary. The blowing device 5E is provided to a charger that is the same as the charger 4B according to the second exemplary embodiment.

Figure 19:
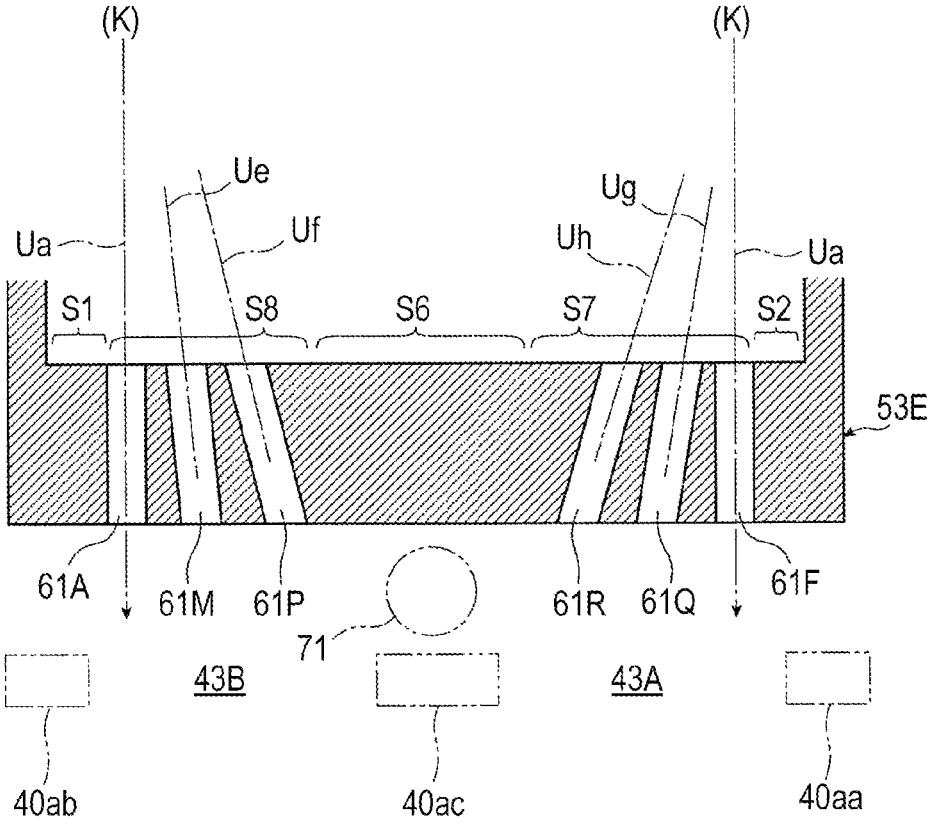
FIG. 19 is a sectional view illustrating the structure of the outlet of the air duct of FIG. 18.

As illustrated in FIGS. 18 and 19, an air duct 51E of the blowing device 5E includes through-portions 60E and 60F that are formed in specific regions S7 and S8 of an outlet 53E. The specific region S7 and S8 are parts of the entire region S of the outlet 53E excluding at least the sub-regions S1, S2, and S6 which respectively face the portions 40*aa* and 40*ab* of the top panel 40*a* of the shield case 40 in which the opening 43 is not formed and the feed guide bar 71 of the cleaner 70.

In the through-portions 60E and 60F in the specific regions S7 and S8 of the outlet 53E, three rows of through-holes 61A, 61M, and 61P and three rows of through-holes 61F, 61Q, and 61R extend in the longitudinal direction B of the specific regions S7 and S8, respectively. In each of the regions S7 and S8, the three rows are arranged in the transversal direction C.

Among the three rows of through-holes 61A, 61M, and 61P of the through-portion 60E, the through-holes 61M and 61P, which are formed in a region excluding an end portion of the specific region S8 of the outlet 53E farther from the center of the outlet 53E in the transversal direction C (a left end portion of the portion S8 in FIG. 19), are formed as air passages that are inclined at different predetermined angles with respect to the reference airflow direction K. Among the three rows of through-holes 61F, 61Q, and 61R of the through-portion 60F, the through-holes 61Q and 61R, which are formed in a region excluding an end portion of the specific region S7 of the outlet 53E farther from the center of the outlet 53E in the transversal direction C (a right end portion of the portion S7 in FIG. 19), are formed as air passages that are inclined at different predetermined angles with respect to the reference airflow direction K.

On the other hand, the through-holes 61A and 61F of the through-portions 60E and 60F are formed in the end portions of the specific regions S8 and S7 that are farther from the center of the outlet 53E so as to extend substantially parallel to (uninclined with respect to) the reference airflow direction K, as with the through-holes 61A and 61F of the outlet 53B according to the second exemplary embodiment. The through-holes 61A, 61M, 61P, 61F, 61Q, and 61R have circular openings with the same diameter and linear cylindrical passages.

As illustrated in FIG. 18, when seen in the reference airflow direction K from the outlet 53E side, the passages of the through holes 61M and 61P and the passages of the through holes 61Q and 61R are inclined at different angles that vary (increase) gradually so that the passages are directed toward portions 42*c* and 42*d* of the grid electrode 42 that are shielded by the middle portion 40*ac* of the shield case 40, in which the opening 43 is not formed, and by the discharge wires 41A and 41B. The inclination angles of the through-holes 61M, 61P, 61Q, and 61R are set so that the through-holes 61P and 61R, which are nearer the center of the outlet 53E in the transversal direction C, have larger angles. The angles (inclinations) between the directions Ue, Uf, Ug, and Uh of the passages of the inclined through-holes 61M, 61P, 61Q, and 61R and the reference airflow direction K are determined in accordance with, for example, the following factors: the distance between the outlet 53E and the top panel 40*a* of the shield case 40, the positional relationship between the outlet 53E and the opening 43 in the top panel 40*a*, and the positional relationship between the opening 43 in the top panel 40*a* and the shielded portions 42*a* and 42*b*.

Hereinafter, the operation of the blowing device 5E will be described.

The blower 50 of the blowing device 5E blows air E at a preset timing such as when the image forming apparatus 1 forms an image. As in the case of the blowing device 5A according to the first exemplary embodiment, the air passes through the connection duct 55 and the inlet 52 of the air duct 51E, and is taken into the passage space 54*a* in the body 54. Then, the air passes through the passage space 54*a* of the intake passage 54A and flows into the passage space 54*a* of the first bent passage 54B (see, for example, arrows E1*a* and E1*b* in FIG. 5). Subsequently, the air flows into the second bent passage 54C (see, for example, the direction of arrow E2*a* in FIG. 18). At this time, air E1, which has flowed into the first bent passage 54B, passes through the gap 57 of the restraining portion 56 as in the case of the air duct 51 according to the first exemplary embodiment.

As illustrated in FIG. 18, air E2, which has flowed into the second bent passage 54C, passes through the through-holes 61 (61A, 61M, 61P, 61F, 61Q, and 61R) as the through-portions 60E and 60F, which are formed in the specific region S3 of the outlet 53E at the end of the second bent passage 54C, and is finally blown out from the outlet 53E (see arrows E6*a*, E6*b*, E6*c*, E6*d*, E6*e*, and E6*f* in FIG. 18).

As described above, the through-holes 61 in the through-portions 60E and 60F of the outlet 53E are formed in the specific regions S8 and S7 of the entire regions S of the outlet 53E. Therefore, the flows of air E6*a*, E6*b*, E6*c*, E6*d*, E6*e*, and E6*f*, which have been blown out from the outlet 53E, pass through the opening 43 formed in the top panel 40*a* of the shield case 40. The air is not blown toward the portions 40*aa* and 40*ab* of the top panel 40*a* of the shield case 40, in which the opening 43 is not formed, and the middle portion 40*ac* of the top panel 40*a*.

Moreover, among the through-holes 61 in the through-portion 60E, the passages of (two rows of) the through-holes 61A and 61F have walls that extend linearly in the reference airflow direction K. Therefore, the flows of air E6*a* and E6*d*, which have been blown out from the through-holes 61A and 61F, move so that the air reliably passes through the two openings 43A and 43B in the shield case 40. On the other hand, among the through-holes 61 in the through-portion 60E, the passages of (the rows of) the inclined through-holes 61M, 61P, 61Q, and 61R have walls that are inclined at different angles with respect to the reference airflow direction K. Therefore, the flows of air E6*b*, E6*c*, E6*e*, and E6*f*, which have been blown out from the through-holes 61, move in directions having the angles θ with respect to the reference airflow direction K, pass through the two openings 43A and 43B in the shield case 40, and then move diagonally in the case 40. Thus, the flows of air E5*b*, E5*c*, and E5*d*, which have been blown out from the inclined through-holes 61, reach the portions 42*c* and 42*d* of the grid electrode, which are respectively shielded by the portions 40*aa*, 40*ab*, and 40*ac* of the top panel of the shield case 40, in which the openings 43A and 43B are not formed, and by the discharge wires 41A and 41B.

As illustrated in FIG. 18, the flows of air E6*a*, E6*b*, E6*c*, E6*d*, E6*e*, and E6*f*, which have been blown out from the outlet 53E of the air duct 51E, pass through the two openings 43A and 43B, which are formed so as to be separated from each other in the top panel 40*a* of the shield case 40 of the charger 4B, and are blown into the case 40. Finally, the air is blown toward the corona discharge wires 41A and 41B, which are respectively disposed at the centers of the two divided spaces inside the case 40, and the grid electrode 42, which is disposed in a lower opening portion of the case 40.

The flows of air E6*a*, E6*b*, E6*c*, E6*d*, E6*e*, and E6*f*, which have been blown out from the through-holes 61 in the outlet 53E, are not blown toward the portions 40*aa*, 40*ab*, and 40*ac* of the top panel 40*a* of the shield case 40, in which the opening 43 is not formed, and the discharge wires 41A and 41B. Therefore, the amount of air that does not reach the corona discharge wires 41A and 41B and the grid electrode 42 and that is wasted is very small. Moreover, the flows of air E6*b*, E6*c*, E6*e*, and E6*f*, which have been blown out from the inclined through-holes 61M, 61P, 61Q, and 61R, reach the portions 42*c* and 42*d* of the grid electrode, which are shielded by the portions 40*aa*, 40*ab*, and 40*ac* of the top panel of the shield case 40, in which the opening 43 is not formed, and the discharge wires 41A and 41B.

Thus, the flows of air E6*a*, E6*b*, E6*c*, E6*d*, E6*e*, and E6*f*, which have been blown out from the outlet 53E, are efficiently blown toward the corona discharge wires 41A and 41B and the grid electrode 42 only with a small loss, although there are interposed components such as parts of the shield case 40 and the discharge wires 41A and 41B. Moreover, the air is also efficiently blown toward the portions 42*c* and 42*d* of the grid electrode 42, which is shielded by the interposed components.

Sixth Exemplary Embodiment

Figure 20:
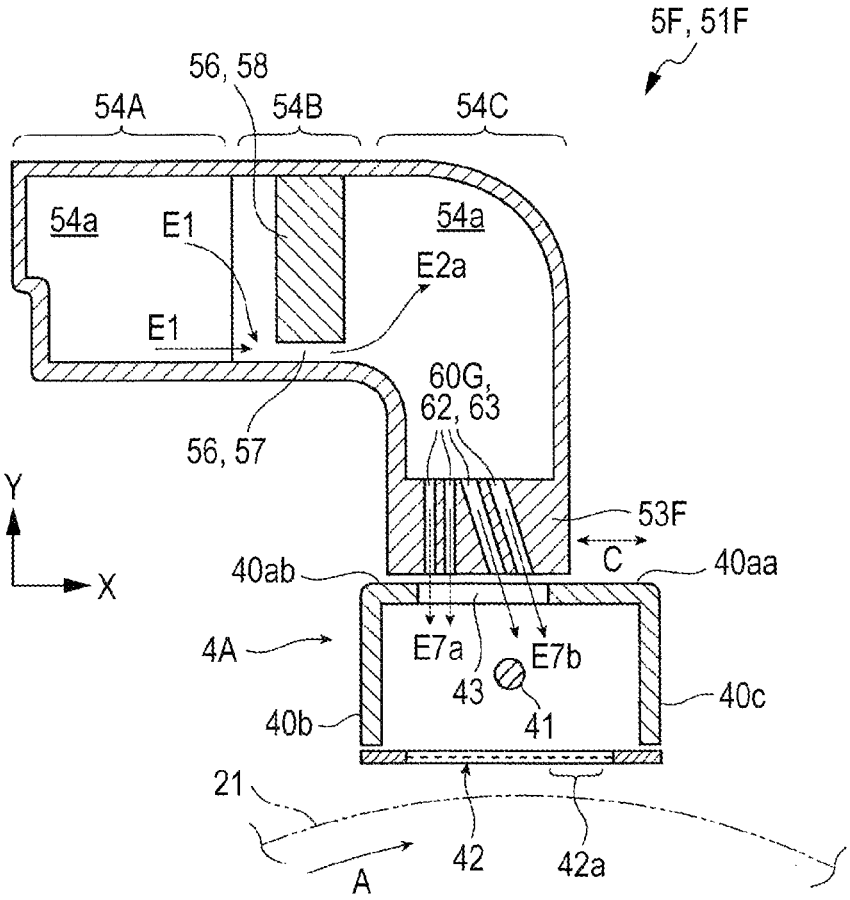
FIG. 20 is a sectional view of an air duct of the blowing device according to a sixth exemplary embodiment, illustrating the structure and the operation of the air duct.

FIG. 20 illustrates a part (air duct) of a blowing device according to a sixth exemplary embodiment. As illustrated in FIG. 20, a blowing device 5F according to the sixth exemplary embodiment differs from the blowing device 5A according to the first exemplary embodiment in that a part of the outlet 53 of the air duct 51 is changed. In other respects, the structure of the blowing device 5F is the same as that of the blowing device 5A. Therefore, in the following description and drawings, the same portions will be denoted by the same numerals and description of such portions will be omitted unless it is necessary. The blowing device 5F is provided to a charger that is the same as the charger 4A according to the first exemplary embodiment.

Figure 21:
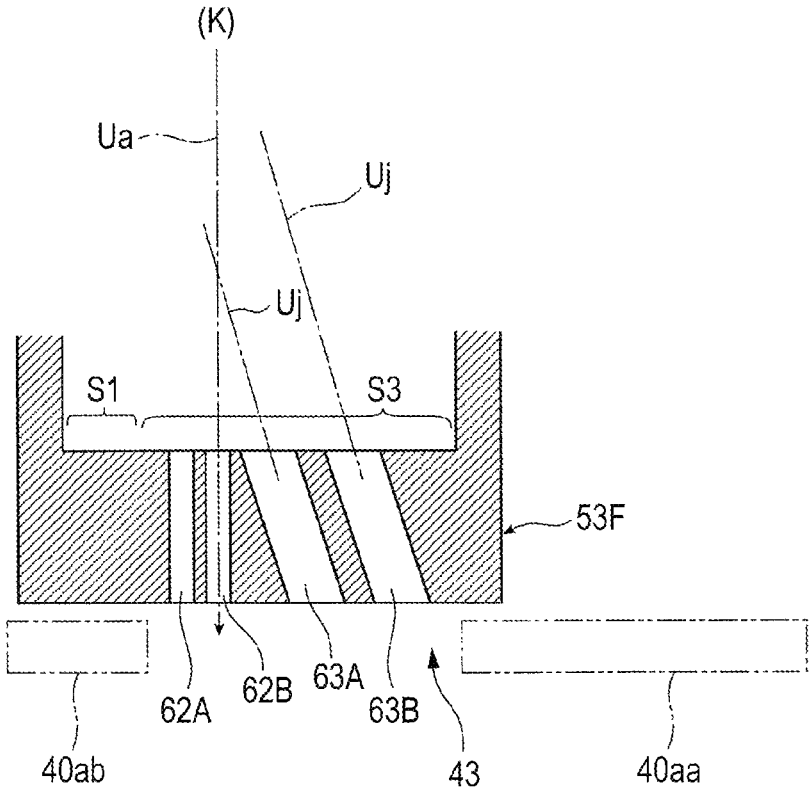
FIG. 21 is a sectional view illustrating the structure of the outlet of the air duct of FIG. 20.

As illustrated in FIGS. 20 and 21, an air duct 51F of the blowing device 5F includes a through-portion 60G that is formed in a specific region S3 of an outlet 53F. The specific region S3 is a part of the entire region S of the outlet 53F excluding at least the sub-region S1, which faces the portion 40*ab* of the shield case 40 in which the opening 43 is not formed.

In the through-portion 60G in the specific region S3 of the outlet 53F, four rows of through-holes 62A, 62B, 63A, and 63B extend in the longitudinal direction B. Among the four rows of through-holes 62A, 62B, 63A, and 63B of the through-portion 60G, the through-holes 63A and 63B are formed near the center of the specific region S3 of the outlet 53F in the transversal direction C (a right end portion of S3 in FIG. 21). The through-holes 63A and 63B are formed as air passages that are inclined with respect to the reference airflow direction K. On the other hand, the through-holes 62A and 62B of the through-portion 60G extend substantially parallel to (uninclined with respect to) the reference airflow direction K, as with the through-holes 61A and 61B of the outlet 53 according to the first exemplary embodiment. The through-holes 62A, 62B, 63A, and 63B have circular openings with the same diameter and linear cylindrical passages.

As illustrated in FIG. 20, when seen in the reference airflow direction K from the outlet 53F side, the passages of the through holes 63A and 63B are inclined so that the passages are directed toward the portion 42*a* of the grid electrode 42, to which air is to be blown, that is shielded by the portion 40*aa* of the shield case 40, in which the opening 43 is not formed. The areas of the openings of the inclined through-holes 63A and 63B (or the diameters of the openings if the openings are circular) are larger than those of the uninclined through-holes 62A and 62B.

When the passages of the inclined through-holes 63A and 63B are longer than the uninclined through-holes 62A and 62B (and if the areas of the openings are the same), the amount of air that passes through the inclined through-holes 63A and 63B may be smaller than that through the uninclined through holes 62A and 62B, and thereby nonuniformity in the distribution, in the transversal direction C, of the amount of air blown out from the outlet 53F may occur. The areas of the openings of the inclined through-holes 63A and 63B are appropriately set so as to reduce such nonuniformity in the amount of air. In setting the areas of the openings in this manner, the areas of the openings of the uninclined through-holes 62A and 62B, which are smaller than those of the inclined through-holes 63A and 63B, may be the same as each other or may be different from each other.

Hereinafter, the operation of the blowing device 5F will be described.

The blower 50 of the blowing device 5F blows air E at a preset timing such as when the image forming apparatus 1 forms an image. As in the case of the blowing device 5A according to the first exemplary embodiment, the air passes through the connection duct 55 and the inlet 52 of the air duct 51F, and is taken into the passage space 54*a* in the body 54. Then, the air passes through the passage space 54*a* of the intake passage 54A and flows into the passage space 54*a* of the first bent passage 54B (see, for example, arrows E1*a* and E1*b* in FIG. 5). Subsequently, the air flows into the second bent passage 54C (see, for example, the direction of arrow E2*a* in FIG. 20). At this time, air E1, which has flowed into the first bent passage 54B, passes through the gap 57 of the restraining portion 56 as in the case of the air duct 51 according to the first exemplary embodiment.

As illustrated in FIGS. 20 and 21, the air E2, which has flowed into the second bent passage 54C, passes through the through-holes 61 (62A, 62B, 63A, and 63B) as the through-portion 60G, which are formed in the specific region S3 of the outlet 53F at the end of the second bent passage 54C, and is blown out from the outlet 53F (see arrows E7*a* and E7*b* in FIG. 20).

As described above, the through-holes 61 in the through-portion 60G of the outlet 53F are formed in the specific region S3 in the entire region S of the outlet 53F. Therefore, flows of air E7*a* and E7*b*, which has been blown out from the outlet 53F, pass through the opening 43 formed in the top panel 40*a* of the shield case 40. The air is not blown toward the portions 40*aa* and 40*ab* of the top panel 40*a* of the shield case 40, in which the opening 43 is not formed.

Moreover, among the through-holes 61 in the through-portion 60G, the passages of (the rows of) the through-holes 62A and 62B have walls that extend linearly in the reference airflow direction K. Therefore, the air E7*a*, which has been blown out from the through-holes 62A and 62B, flows so that the air reliably passes through the opening 43 in the shield case 40. On the other hand, among the through-holes 61 in the through-portion 60*g*, the passages of (two row of) the through-holes 63A and 63B have walls that are inclined at an angle with respect to the reference airflow direction K. Therefore, the air E7*b*, which has been blown out from the through-holes 63A and 63B, flows in a direction having the angle θ with respect to the reference airflow direction K, passes through the opening 43 in the shield case 40, and then flows diagonally in the case 40. Thus, the air E7*b*, which has been blown out from the inclined through-holes 63A and 63B, reaches the portion 42*a* of the grid electrode, which is shielded by the portion 40*aa* of the top panel of the shield case 40 in which the opening 43 is not formed.

The amount of air E7*b* blown out from the inclined through-holes 63A and 63B is larger than that of the air E7*a* blown out from the through-holes 62A and 62B, because the areas of the openings of the inclined through-holes 63A and 63B are larger than those of the uninclined through-holes 62A and 62B. Therefore, the distribution of the amount of (the flows E7*a* and E7*b* of) air, which is blown out from the entirety of the through-portion 60G, in the transversal direction C of the outlet 53F (which is substantially the same as the rotation direction A of the photoconductor drum 21) is made substantially uniform (the difference in the amounts of the flows of air E7*a* and E7*b* are substantially zero).

As illustrated in FIG. 20, the flows of air E7*a* and E7*b*, which have been blown out from the outlet 53F of the air duct 51F, pass through the opening 43, which is formed so as to be displaced in the top panel 40*a* of the shield case 40 of the charger 4A, and is blown into the case 40. Finally, the air is blown toward the corona discharge wire 41, which is disposed at the center of the space inside the case 40, and the grid electrode 42, which is disposed in a lower opening portion of the case 40.

The flows of air E7*a* and E7*b*, which have been blown out from the outlet 53F, are not blown toward the portions 40*aa* and 40*ab* of the top panel 40*a* of the shield case 40, in which the opening 43 is not formed. Therefore, the amount of air that does not reach the corona discharge wire 41 and the grid electrode 42 and that is wasted is very small. Moreover, the air E7*b*, which has been blown out from the inclined through-holes 63A and 63B, reaches the portion 42*a* of the grid electrode, which is shielded by the portion 40*aa* of the top panel of the shield case 40 in which the opening 43 is not formed. The amount of air E7*b* blown out from the through-holes 63A and 63B is substantially the same as that of air E7*a* blown out from the uninclined through-holes 62A and 62B.

Thus, the flows of air E7*a* and E7*b*, which have been blown out from the outlet 53F, are efficiently blown toward the corona discharge wire 41 and the grid electrode 42 only with a small loss, although there are interposed components such as parts of the shield case 40. Moreover, the air is also efficiently blown toward the portion 42*a* of the grid electrode 42, which is shielded by the interposed components.

In particular, with the blowing device 5F, wastes are more effectively prevented from adhering to the entire region of the grid electrode 42 (in particular, in the transversal direction C) than in the cases of the blowing devices 5C and 5D according to the third and fourth exemplary embodiments. Therefore, the photoconductor drum 21 is more uniformly charged in the rotation direction A (process direction) than in the cases of the blowing devices 5C and 5D. As a result, occurrence of nonuniform charging in the process direction and forming of a nonuniform image due to the nonuniform charging are reliably prevented.

Other Exemplary Embodiments

Figure 22:
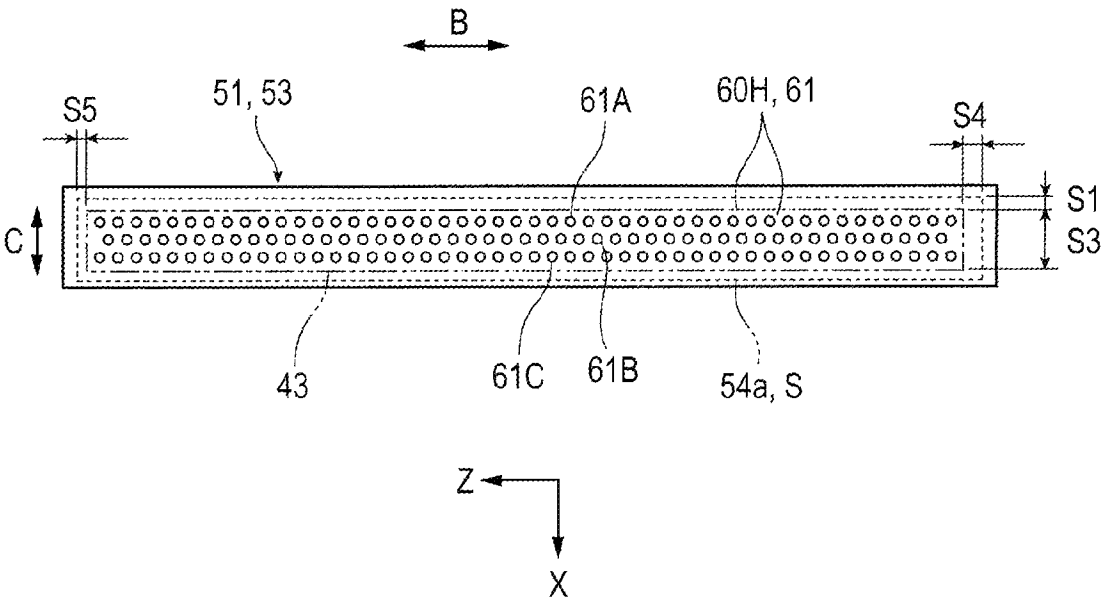
FIG. 22 illustrates another arrangement pattern of through-holes of the opening of the outlet of the air duct.

In the blowing devices 5A to 5F according to the first to sixth exemplary embodiments, the through-portion 60 of the outlet 53 of the air duct 51 includes the through-holes 61, which have circular cross sections and are arranged in a matrix pattern at a regular pitch in the longitudinal direction B and in the transversal direction C of the outlet 53 (see FIGS. 6 and 12). However, the through-holes 61 may be arranged in a different pattern. For example, as illustrated in FIG. 22, a through-portion 60I including the (rows of) through-holes 61 that are arranged in a staggered manner may be used.

In the case where the through-holes 61 are dot-shaped holes formed in the through-portion 60 of the outlet 53 of the air duct 51, the openings of the through-holes 61 need not be circular and may have another shape (such as a triangular, a square, or a polygonal shape).

The through-holes 61 of the through-portions 60 of the outlet 53 of the air duct 51 need not be dot-shaped holes that are commonly described in the first to sixth exemplary embodiments. Through-holes of different type may be used.

Figure 23A:
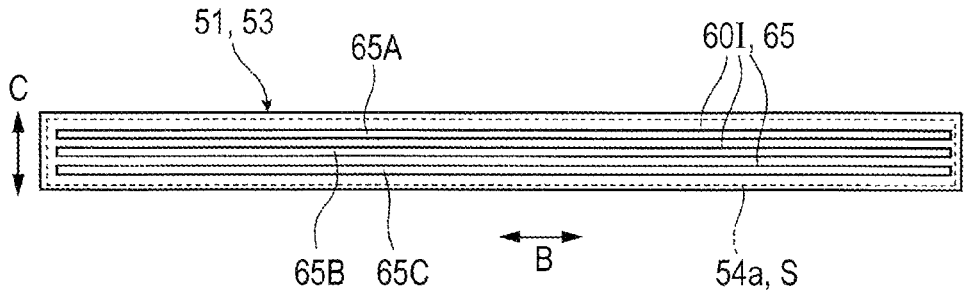
FIGS. 23A to 23C illustrate other examples of through-holes of the opening of the outlet of the air duct.
Figure 23B:
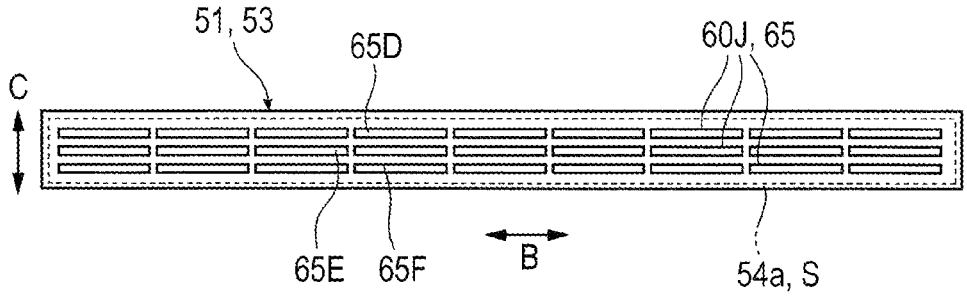
Figure 23C:
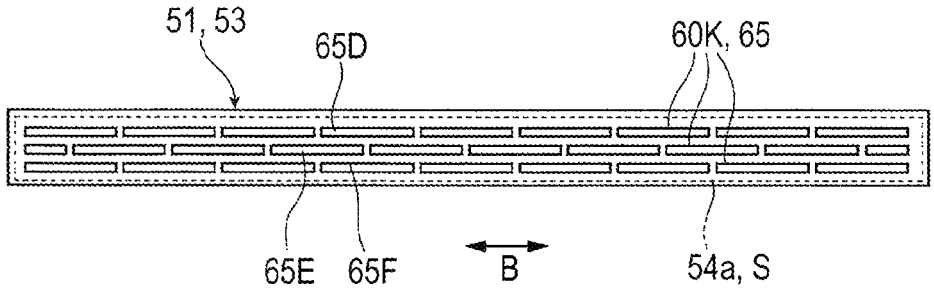

For example, as illustrated in FIGS. 23A to 23C, the through-portion 60 may include plural through holes 65 each having an oblong shape (for example, a rectangular shape). FIG. 23A illustrates a through-portion 60H including three rows of through-holes 65A, 65B, and 65C, each having a length that is substantially the same as the length of the region S of the outlet 53 in the longitudinal direction B. The three rows are arranged in the transversal direction C at a regular pitch. FIG. 23B illustrates a through-portion 60J including three rows of through-holes 65D, 65E, and 65F, each having a short length that is a fraction of the total length of the regions S of the outlet 53 in the longitudinal direction B. In each of the rows, the through-holes are arranged at a regular pitch in the longitudinal direction B, and the three rows are arranged at a regular pitch in the transversal direction C. FIG. 23C illustrates a through-portion 60K including three rows of the short through-holes 65D, 65E, and 65F. In each of the rows, the through-holes are arranged in the longitudinal direction B at a regular pitch, and the three rows are arranged in a staggered manner in the transversal direction C. In FIGS. 23A to 23C, the through-holes 65 are formed, for example, in the outlet 53 or 53C of the air duct 51 or 51B according to the first or third exemplary embodiments. However, the same arrangement of the through-holes may be used for the outlet 53B or 53F of the air duct 51B or 51F of the second or sixth exemplary embodiment.

Interposed components that are interposed between the outlet 53 of the air duct 51 of the blowing device 5 and a target component of the charger 4 toward which air is to be blown are not limited to parts of the shield case 40, components of the cleaner 70, and the discharge wire 41, which have been described in the first to sixth exemplary embodiments; and may be other components and the like. The cleaner 70 may be a manual cleaner. Here, the term "manual cleaner" refers to a cleaner including, for example, an operation bar that substantially corresponds to the feed guide bar 70 of the automatic cleaner 70, a movable member attached to an end of the operation bar, and a cleaning member attached to an arm portion of the movable member. Cleaning is performed by reciprocating the operation bar in the longitudinal direction B of the charger 4. In this case, the operation bar is an interposed component that is always located above the top panel 40*a* of the shield case 40 when cleaning is not performed.

The charger 4, to which the blowing device 5 is provided, may be a so-called corotron corona discharge unit that does not include the grid electrode 42. A corona discharge unit toward which the blowing device 5 blows air may be a corona discharge unit that removes charges of the photoconductor drum 21, or a corona discharge unit that charges or removes charges from an object other than the photoconductor drum.

The configuration of the image forming apparatus 1, such as the method of forming an image, is not particularly limited as long as the image forming apparatus 1 includes a corona discharge unit toward which the blowing device 5 needs to blow air. As appropriate, the image forming apparatus 1 may be an image forming apparatus that forms an image that is not composed of a developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blowing device comprising:

a blower configured to blow air; and an air duct comprising an inlet and an outlet, the air duct configured to take in the air through the inlet and configured to guide the air so that the air flows out in an airflow direction through the outlet toward a corona discharge unit comprising a target component toward which the air is to be blown, wherein the outlet of the air duct comprises a through-portion in a non-overlapping region thereof, the non-overlapping region being a region of the outlet excluding an overlapping region of the outlet, the overlapping region corresponding to an interposed component of the corona discharge unit, the interposed component being located at an upstream side of the target component in the airflow direction at a position at which the interposed component overlaps the overlapping region.

2. The blowing device according to claim 1, wherein the outlet of the air duct comprises a plurality of the through-portions, and wherein at least one of the plurality of through-portions is formed as an inclined air passage that is relatively inclined in a direction toward a portion of the target component, the portion being shielded by the interposed component as seen from the outlet side.

3. The blowing device according to claim 2, wherein the through-portions comprise at least one inclined air passage and at least one uninclined air passage, and wherein an area of an opening of each of the at least one inclined air passage is larger than an area of an opening of each of the at least one uninclined air passage.

4. The blowing device according to claim 2, wherein the plurality of the through-portions comprise a plurality of inclined air passages, and the through-portions formed as the inclined air passages are arranged such that there are a plurality of the through-portions along a movement direction in which an object moves, the object being subjected to corona discharge by the corona discharge unit, and wherein the plurality of through-portions that are arranged in the movement direction are formed such that an inclination of the inclined air passages of the through-portions gradually increases downstream in the movement direction.

5. The blowing device according to claim 1, wherein the through-portion comprises a dot-shaped hole.

6. The blowing device according to claim 1, wherein the interposed component comprises at least one of a covering member and a cleaner component of a cleaner configured to clean the target component, the covering member having an air inlet provided at a position at which the covering member overlaps the overlapping region of the outlet of the air duct, the cleaner component being disposed at a position at which the cleaner component overlaps the overlapping region of the air duct.

7. An image forming apparatus comprising:

a corona discharge unit including a target component toward which air is to be blown; and the blowing device according to claim 1 configured to blow air toward the corona discharge unit.

8. The blowing device according to claim 1, wherein the through-portion is attached to the outlet of the air duct and is spaced apart from the corona discharge unit.

9. The blowing device according to claim 1, wherein through-portion is configured to take in the air from the blower and guide the air taken from the blower toward the corona discharge unit.

10. The blowing device according to claim 1, wherein the through-portion is only in the non-overlapping region of the outlet.

* * * * *